US007195060B2

(12) United States Patent
Martin et al.

(10) Patent No.: US 7,195,060 B2
(45) Date of Patent: Mar. 27, 2007

(54) STACKED-TUBE HEAT EXCHANGER

(75) Inventors: Michael A. Martin, Hamilton (CA); Alan K. Wu, Kitchener (CA)

(73) Assignee: Dana Canada Corporation (CA)

( * ) Notice: Subject to any disclaimer, the term of this patent is extended or adjusted under 35 U.S.C. 154(b) by 69 days.

(21) Appl. No.: 11/097,475

(22) Filed: Apr. 1, 2005

(65) Prior Publication Data

US 2006/0219394 A1 Oct. 5, 2006

(51) Int. Cl.
*F28D 7/16* (2006.01)

(52) U.S. Cl. ..... 165/157; 165/166

(58) Field of Classification Search ..... 165/157, 165/158, 166

See application file for complete search history.

(56) References Cited

U.S. PATENT DOCUMENTS

| | | | | |
|---|---|---|---|---|
| 2,912,749 | A | 11/1959 | Bauernfeind et al. | |
| 3,297,081 | A | 1/1967 | Nunemaker | |
| 4,002,201 | A * | 1/1977 | Donaldson | 165/140 |
| 4,501,321 | A * | 2/1985 | Real et al. | 165/153 |
| 4,587,949 | A | 5/1986 | Schott | |
| 4,632,066 | A | 12/1986 | Kideys | |
| 4,681,155 | A | 7/1987 | Kredo | |
| 4,977,742 | A | 12/1990 | Meijer | |
| 5,078,207 | A | 1/1992 | Asano et al. | |
| 5,799,727 | A | 9/1998 | Liu | |
| 6,012,512 | A | 1/2000 | Ghiani | |
| 6,068,050 | A | 5/2000 | Ghiani | |
| 6,105,665 | A | 8/2000 | Ghiani | |
| 6,192,977 | B1 | 2/2001 | Dey et al. | |
| 6,213,105 | B1 | 4/2001 | Banzhaf et al. | |
| 6,213,158 | B1 | 4/2001 | Rhodes et al. | |
| 6,269,870 | B1 * | 8/2001 | Banzhaf et al. | 165/158 |
| 6,293,334 | B1 | 9/2001 | Ghiani | |
| 6,293,337 | B1 * | 9/2001 | Strahle et al. | 165/166 |
| 6,321,835 | B1 | 11/2001 | Damsohn et al. | |
| 6,364,007 | B1 * | 4/2002 | Fischer | 165/166 |
| 6,397,937 | B1 * | 6/2002 | Ghiani | 165/140 |
| 6,513,585 | B2 | 2/2003 | Brost et al. | |
| 6,668,916 | B2 * | 12/2003 | Zobel et al. | 165/176 |
| 2001/0037878 | A1 * | 11/2001 | Brost et al. | 165/175 |
| 2003/0019616 | A1 | 1/2003 | Hayashi et al. | |
| 2003/0079869 | A1 | 5/2003 | Brunner et al. | |
| 2005/0144978 | A1 * | 7/2005 | Papapanu | 62/515 |
| 2005/0189097 | A1 * | 9/2005 | Fowser et al. | 165/166 |
| 2006/0011333 | A1 | 1/2006 | Emrich et al. | |

OTHER PUBLICATIONS

PCT International Search Report for App. No. PCT/CA2006/000431 completed Jun. 13, 2006.
English language Abstract of JP 07-159076.
English language Abstract of JP 2000-039287.

* cited by examiner

*Primary Examiner*—Teresa J. Walberg
(74) *Attorney, Agent, or Firm*—Dykema Gossett PLLC

(57) ABSTRACT

A headerless heat exchanger has a core comprised of a stack of flat tubes of rectangular cross section through which a first heat exchange fluid passes. The tubes are expanded in height at their end portions to provide spaces between adjacent plate pairs for passage of a second heat exchange fluid between the tubes. The sides of the tubes are coplanar, at least in the end portions of the tubes, to provide flat surfaces along which the core is sealed to side plates of the heat exchanger, for example by brazing or welding. The side plates may be separately formed or may comprise part of a continuous housing. The tubes are preferably formed from plate pairs having nesting side walls.

29 Claims, 16 Drawing Sheets

164
184
204
154
166
200
167
172
162
168
152'
206
167
170
178
174
208
158
156
202
167
168
210
172
186
188
168
188
182
198
176
180
190
178
152"
186
196
192
194

68
70
254
182
184
250
172
252
252
256

STACKED-TUBE HEAT EXCHANGER

FIELD OF THE INVENTION

The invention relates to heat exchangers, and particularly to heat exchangers including a stack of spaced-apart tubes and/or plate pairs which define flow passages for first and second fluids.

BACKGROUND OF THE INVENTION

Heat exchangers are commonly constructed from stacks or bundles of spaced-apart flat tubes, in which the interiors of the tubes define flow passages for a first fluid and in which spaces between adjacent tubes define flow passages for a second fluid. The flat tubes may comprise pairs of flat plates joined together at their margins.

The ends of the tubes in the stack or bundle are usually retained by a perforated header or tube sheet and the spaces between the plates may be at least partially enclosed by a housing. Examples of exhaust gas heat exchangers of this type are shown in U.S. Pat. No. 6,293,337 (Strahle et al.) and in U.S. Pat. No. 6,269,870 (Banzhaf et al.).

It is also known to construct heat exchangers comprising bundles of spaced-apart flat tubes in which the need for a perforated header is eliminated. An example of a heat exchanger having this type of construction is described in U.S. Pat. No. 6,321,835 (Damsohn et al.). In this patent, the ends of the heat exchanger tubes are expanded in width and height relative to the central portions of the tubes. The tube ends are sealed directly to one another and to the housing, thereby eliminating the need for a perforated header.

There remains a need to provide stacked-tube heat exchangers of simplified, reliable construction and to improve and simplify processes for manufacturing such heat exchangers.

SUMMARY OF THE INVENTION

In one aspect, the present invention provides a heat exchanger for heat transfer between a first fluid and a second fluid. The heat exchanger comprises: (a) a core comprising a stack of tubes, each of the tubes having a top wall, a bottom wall, side walls connecting the top and bottom walls, a hollow interior enclosed by the top, bottom and side walls, and inlet and outlet openings for the first fluid, wherein each of the tubes has a pair of end portions spaced apart along a longitudinal axis and a central portion located between the end portions, the end portions of adjacent tubes in the stack being sealed to one another along their top and bottom walls, wherein the end portions are greater in height than the central portions of the tubes such that the central portions of adjacent tubes in the stack are spaced from one another; (b) a plurality of first fluid flow passages, each of which comprises the hollow interior of one of the tubes and extends longitudinally from the first fluid inlet opening to the first fluid outlet opening; (c) a plurality of second fluid flow passages, each of which comprises the space between the central portions of an adjacent pair of the tubes, each of the second fluid flow passages having a pair of longitudinally-spaced ends and a pair of transversely spaced sides, each of the second fluid flow passages being sealed along its ends by the end portions of the adjacent pair of tubes; and (d) a pair of side plates covering the transversely spaced sides of the second fluid flow passages, the side plates engaging the side walls of the tubes in the stack and being sealed to the tube side walls in the end portions of the tubes, wherein an inlet manifold is provided in one of the side plates and an outlet manifold is provided in one of the side plates, each of the manifolds communicating with each of the second fluid flow passages.

In another aspect, the present invention provides a method for manufacturing a heat exchanger according to the invention. The method comprises: (a) stacking the tubes to form the core; (b) attaching the U-shaped side plates to opposite sides of the core with one of the longitudinally-extending edges of each side plate engaging the top wall of the uppermost tube in the core and the other edge of each side plate engaging the bottom wall of the lowermost tube in the core, wherein the edges of the side plates frictionally engage the uppermost and lowermost tubes to retain the tubes in position in the core; and (c) heating the core with the attached side plates for a time and at a temperature sufficient to seal the end portions of adjacent tubes together, to seal the longitudinally-extending edges of the side plates to the uppermost and lowermost tubes in the core, and to seal the side plates to the tube side walls in the end portions of the tubes and to tubes to one another and to the side plates.

BRIEF DESCRIPTION OF THE DRAWINGS

The invention will now be described, by way of example only, with reference to the accompanying drawings in which.

DETAILED DESCRIPTION OF PREFERRED EMBODIMENTS

Figure 1:
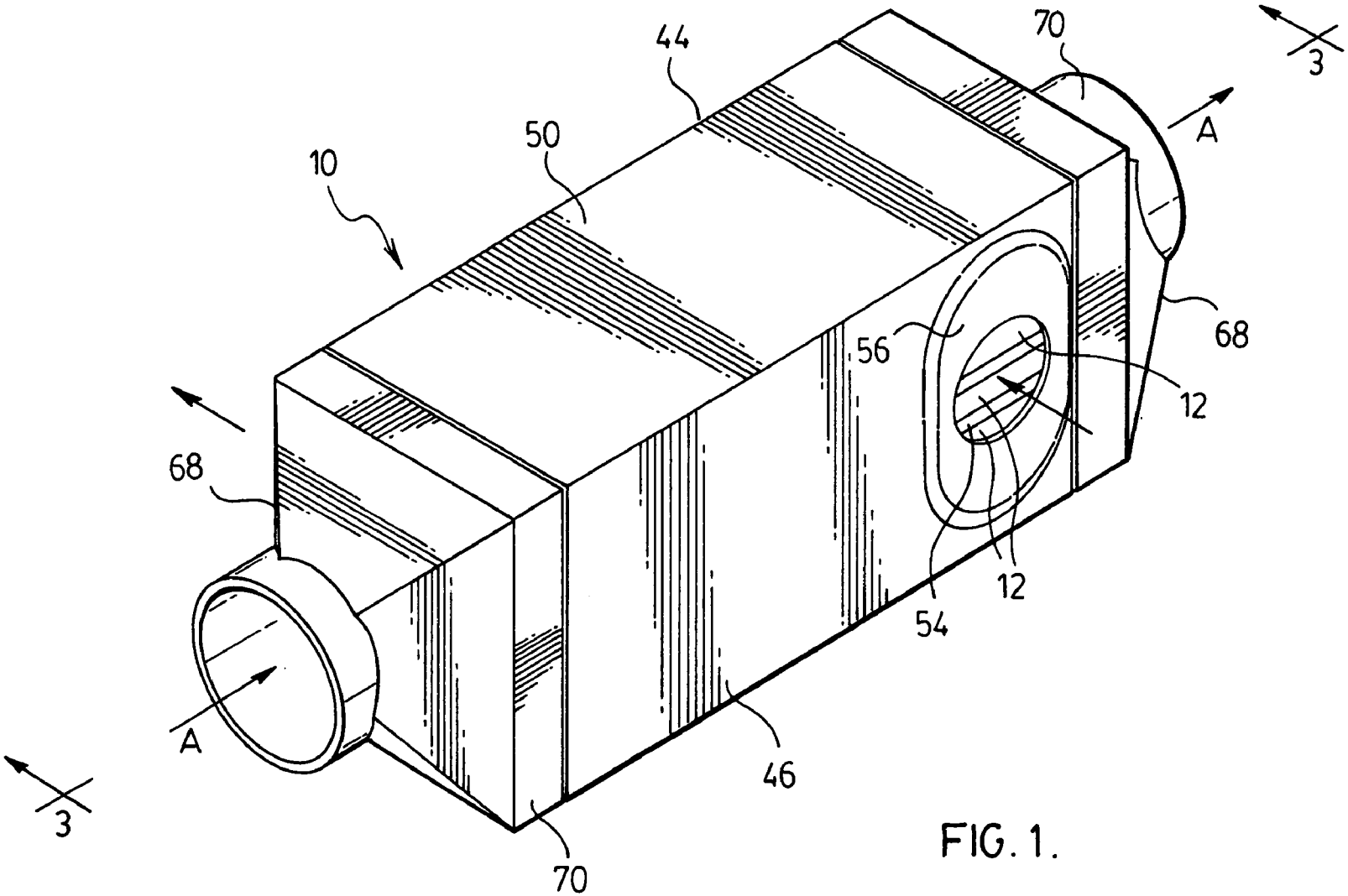
FIG. 1 is a perspective view of a heat exchanger according to a first preferred embodiment of the invention.
Figure 2:
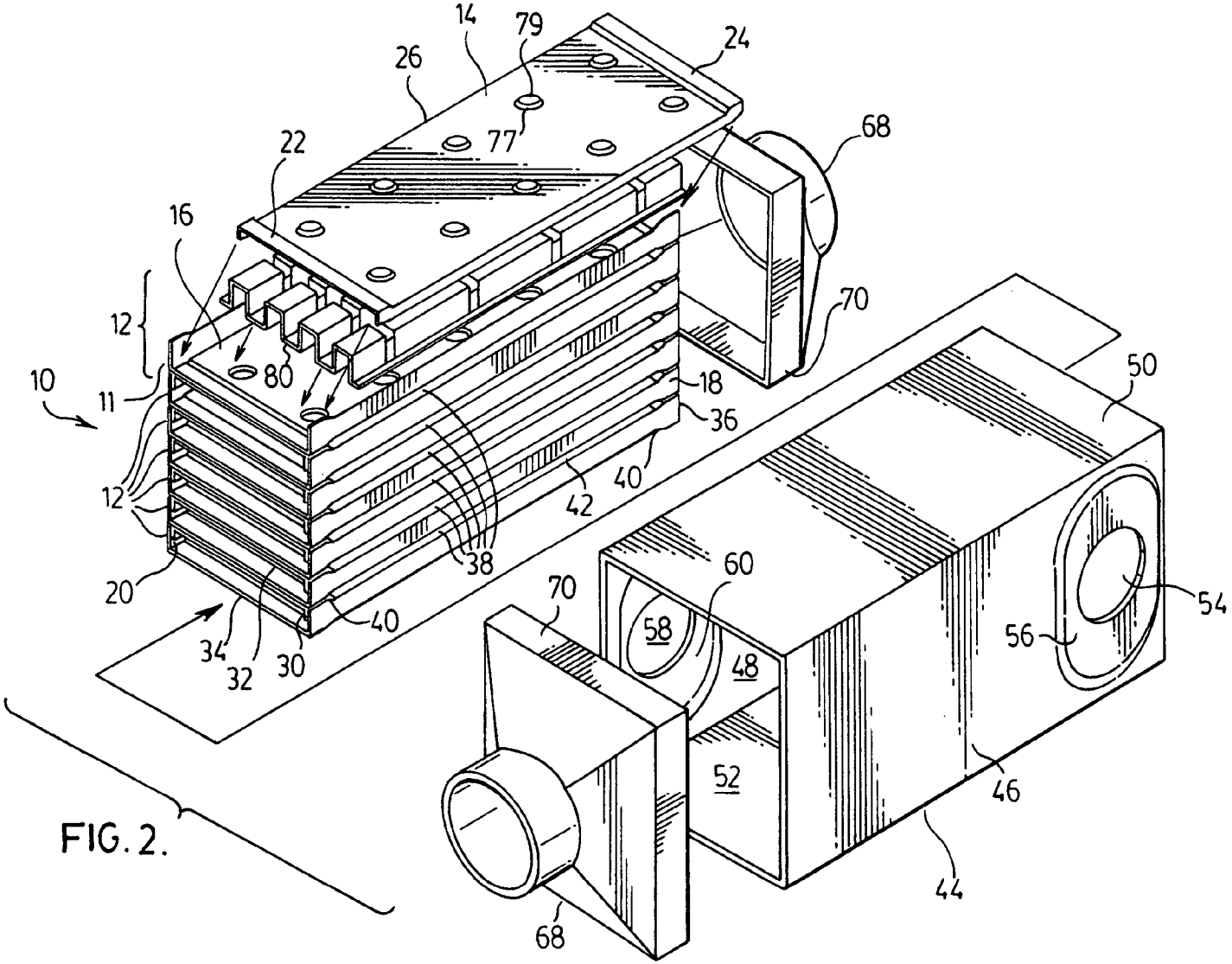
FIG. 2 is an exploded perspective view of the heat exchanger of FIG. 1.

Heat exchangers according to the invention are suited for use as exhaust gas coolers for vehicular applications in which hot exhaust gases are cooled by a liquid coolant, for example to cool or prevent overheating of the catalyst in a catalytic converter and/or to provide supplementary cabin heating. It will, however, be appreciated that the heat exchangers described herein can be applied to a number of different uses other than the cooling of exhaust gases. For example, heat exchangers according to the invention can be used for reformer-based fuel processors.

A first preferred heat exchanger 10 is illustrated in FIGS. 1 to 5. Heat exchanger 10 comprises a core 11 (FIGS. 2, 3 and 5) comprising a stack of open-ended tubes 12, each of which has a top wall 14, an opposed bottom wall 16 and a pair of opposed side walls 18, 20. The tubes 12 each have a pair of end portions 22, 24 spaced apart along longitudinal axis A and a central portion 26 located between the end portions 22, 24. The central portions 26 of adjacent tubes 12 are spaced apart while the end portions 22, 24 of adjacent tubes 12 are sealed to one another along their top and bottom walls 14, 16.

In heat exchanger 10, the tubes 12 have a rectangular cross-section when viewed in a transverse plane, with the top and bottom walls 14, 16 being substantially flat and parallel to one another and with the side walls 18, 20 being substantially flat and parallel to one another. It will, however, be appreciated that the tubes 12 may be of other suitable shapes, preferably having substantially flat top and bottom walls 14, 16. For example, the cross sections of tubes 12 may be shaped as elongate hexagons or as elongate ovals in which the side walls 18, 20 are multi-faceted or rounded. However, it is preferred that the tubes 12 have an elongate rectangular cross sectional shape, as shown in the drawings, so as to simplify the shapes of other components of the heat exchanger, which are described below.

The tubes 12 in heat exchanger 10 are of constant width and have end portions 22, 24 which are expanded in the vertical direction so that the end portions 22, 24 have a height which is greater than a height of the central portions 26 of tubes 12. This permits the central portions 26 of the tubes 12 to be spaced apart while the end portions 22, 24 of adjacent tubes 12 may be sealed directly to one another without the need for a perforated header or tube sheet. It will be appreciated that the width of the tubes is not necessarily constant throughout their length.

Heat exchanger 10 includes fluid flow passages for heat exchange between a first fluid and a second fluid, which may be either liquid or gaseous. A plurality of first fluid flow passages 30 is defined by the hollow interiors of tubes 12. Each of the first fluid flow passages 30 extends longitudinally from one open end 34 to another open end 36 of a tube 12. Where heat exchanger 10 comprises an exhaust gas cooler, the first fluid is preferably a hot engine exhaust gas.

Figure 3:
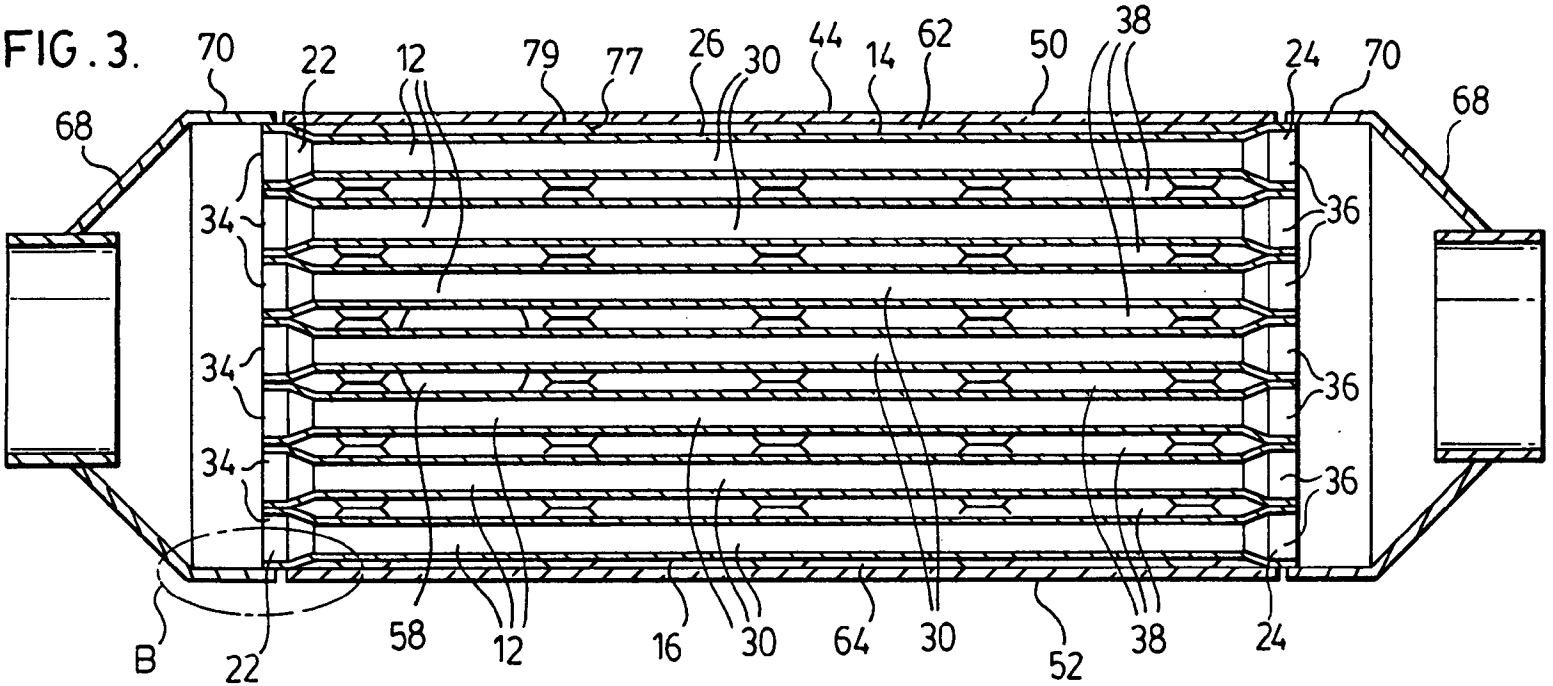
FIG. 3 is a cross section along the line 3–3' of FIG. 1.
Figure 4A:
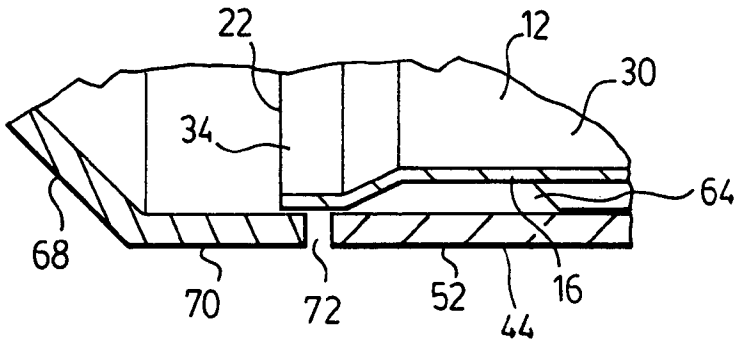
FIG. 4A is a close-up of area B of FIG. 3.
Figure 4B:
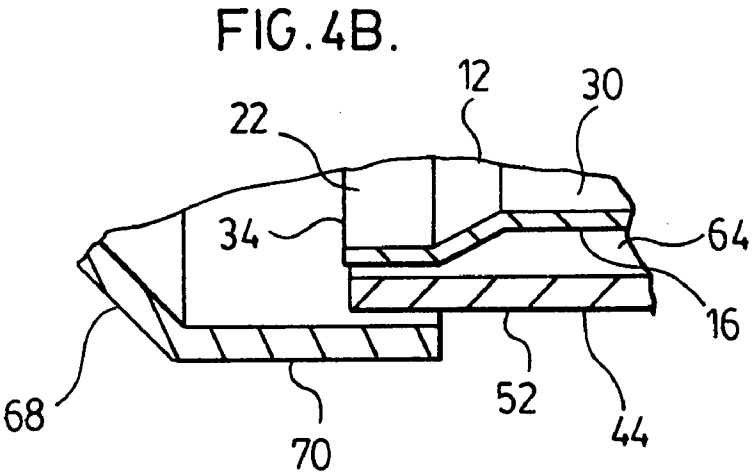
FIG. 4B is a close-up of area B of FIG. 3 according to a variant of the first preferred embodiment.
Figure 4C:
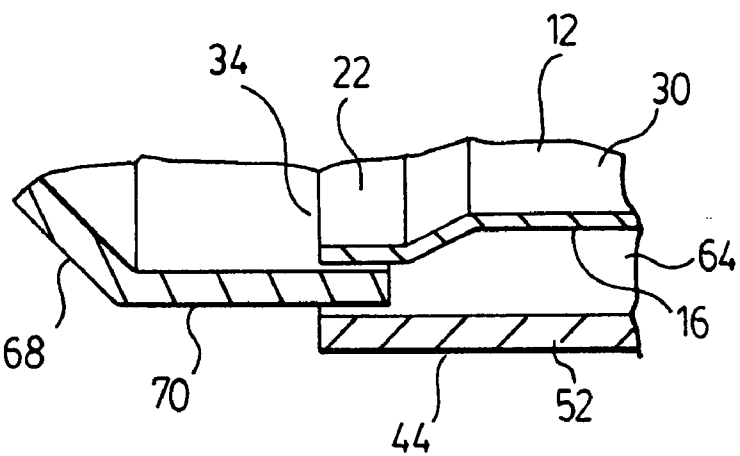
FIG. 4C is a close-up of area B of FIG. 3 according to another variant of the first preferred embodiment.

A plurality of second fluid flow passages 38 is defined by the spaces between the central portions 26 of adjacent tubes 12. Each of the second fluid flow passages 38 has a pair of longitudinally-spaced ends 40 and a pair of transversely spaced sides 42. As shown in FIG. 3, the second fluid flow passages 38 are sealed along their ends 40 by the sealed end portions 22, 24 of the adjacent tubes 12 between which they are formed.

The heat exchanger 10 further comprises a housing 44 which covers the top, bottom and sides of the core 11. The housing 44 is open-ended, has a rectangular transverse cross section and comprises a pair of side plates 46, 48 and a pair of end plates 50, 52. As shown in the drawings, the housing 44 may comprise a pre-formed rectangular casing made from a drawn pipe which is formed into a rectangular shape, or from sheet metal which is stamped or folded into a rectangular shape and joined along a seam by welding or brazing. Although the housing 44 is shown in the drawings as having a rectangular shape, it will be appreciated that it may have any other suitable shape, depending on the shape of the core 11.

The side plates 46, 48 of housing 44 substantially enclose the sides 42 of the second fluid flow passages 38 and may preferably engage the side walls 18, 20 of the tubes 12, thereby substantially preventing bypass flow between the tube side walls 18, 20 and the side plates 46, 48. In the preferred heat exchanger 10, the side plate 46 is provided with an inlet opening 54 which is formed in a raised inlet manifold 56. The manifold 56 comprises a raised portion of side plate 46 which extends throughout substantially the entire height of the side plate 46 so as to permit flow communication between the inlet opening 54 and each of the second fluid flow passages 38. The other side plate 48 is provided with an outlet opening 58 and an outlet manifold 60 substantially identical to the inlet opening and manifold 54, 56 described above. Although heat exchanger 10 has inlet and outlet openings 54, 58 and the associated manifolds 56, 60 formed in opposite side plates 46, 48 of housing 44, they may instead be provided in the same side plate 46 or 48. Furthermore, where the openings 54, 58 are provided in opposite side plates 46, 48, it will be appreciated that they are not necessarily offset from one another. Rather, the openings 54, 58 may be located directly opposite to one another, as will be discussed below in more detail.

The end plates 50, 52 extend between and are connected to the side plates 46, 48. As shown in FIG. 3, an additional second fluid flow passage 62 is formed between the top end plate 50 and the top wall 14 of the uppermost tube 12 of core 11, and an additional fluid flow passage 64 is formed between the bottom end plate 52 and the bottom wall 16 of the lowermost tube 12 of core 11. These passages 62, 64 are also in communication with the inlet and outlet openings 54, 58 through manifolds 56, 60.

Figure 5:
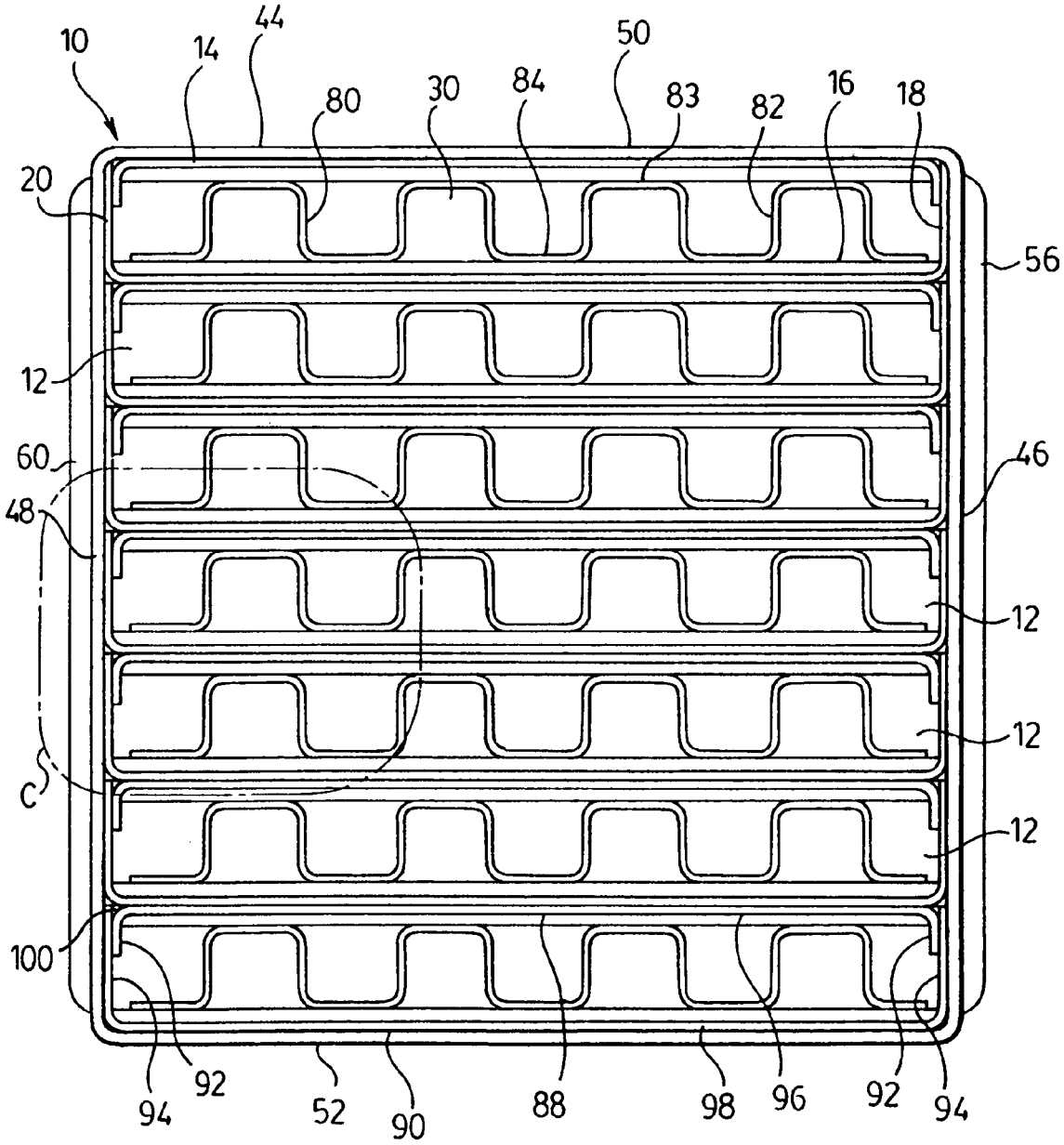
FIG. 5 is a front elevation view of the heat exchanger of FIG. 1, with the end caps removed.

Referring now to FIGS. 3 and 4, it will be seen that the longitudinally-spaced ends of housing 44 are sealed to the end portions of the tubes 12 in the core 11, thereby sealing the ends of the second fluid flow passages 38, 62, 64. Specifically, as shown in FIG. 3, it will be seen that the ends of top end plate 50 overlap with and sealingly engage the end portions 22, 24 of uppermost tube 12 and the ends of bottom end plate 52 overlap with and sealingly engage the end portions 22, 24 of the lowermost tube 12. Similarly, as shown in FIG. 5, the side plates 46, 48 of housing 44 sealingly engage the side walls 18, 20 of tubes 12, at least along their end portions 22, 24, throughout the height of the core 11.

The heat exchanger 10 preferably also comprises a pair of end fittings 68 which, in the first preferred embodiment, are identical to each other. Fittings 68 form an inlet and outlet for the first fluid and are in flow communication with the first fluid flow passages 30 at the ends 34, 36 of tubes 12. Each of the end fittings 68 has a longitudinally-extending flange 70 which is of substantially square or rectangular shape. The flange 70 fits over and is sealed to the end portions 22, 24 of the stacked tubes 12 or, as described below in greater detail, may overlap the ends of housing 44.

There are various methods by which the heat exchanger 10 may be assembled. According to one method, the tubes 12 comprising the core 11 are brazed together and the core 11 is then slid as a unit into a pre-formed housing 44, with the walls 46, 48, 50 and 52 overlapping the ends 22, 24 of the tubes 12. The end fittings 68 are then slid over the ends of the core 11, with a small gap 72 being provided between the flange 70 and the housing 44, as shown in the close-up of FIG. 4A. The provision of gap 72 is advantageous where the fittings 68, housing 44 and core 11 are simultaneously brazed or welded together. The gap 72 is filled by a filler metal during brazing or welding, and the filler metal is drawn into the gaps between the tubes 12, the housing 44 and the end fittings 68 by capillary flow, thereby ensuring a leak-proof seal. Alternatively, the flanges 70 of fittings 68 may overlap the ends of the housing 44, as shown in the close-up of FIG. 4B.

In other assembly methods, the housing 44 may be formed from a sheet of metal which is wrapped around the core 11, held in tension and then fastened together by welding, mechanical fasteners or staking. In this type of assembly method, the end fittings 68 can be applied to the core either before or after the housing 44. For example, the end fittings 68 may first be applied over the ends of an unbrazed core 11, whereby frictional engagement between the flanges 70 of the end fittings 68 and the tubes 12 is sufficient to hold the core together during brazing. This reduces or eliminates the need for additional fixturing means to keep the tubes 12 from shifting their relative positions in the tube stack prior to brazing. Accordingly, the end fittings 68 provide "self-fixturing" during assembly of the heat exchanger and simplify the manufacturing process. The fittings 68 and core 11 are then brazed together. The housing 44 is subsequently wrapped around the core 11 and may either overlap the flanges 70 of the end fittings 68, as shown in the close-up of FIG. 4C or be spaced from the fittings as in FIG. 4A. The housing 44 is then welded to the flanges 70 and to the underlying tubes 12.

As shown in FIG. 3, the central portions 26 of tubes 12 are preferably provided with upstanding protrusions 77 in one or both of their top and bottom walls 14, 16. In all but the uppermost and lowermost tubes 12, the upper surfaces 79 of protrusions 77 engage the top or bottom wall 14, 16 or a protrusion 77 of an adjacent tube 12. The protrusions 77 in the top wall 14 of the uppermost tube 12 preferably engage the end wall 50 of housing 44 and the protrusions 77 in the bottom wall 16 of the lowermost tube preferably engage the end wall 52 of housing 44. It will be appreciated that protrusions 77 assist in maintaining the spaces between the central portions 26 of adjacent tubes 12 by providing support between the top and bottom walls 14, 16, thereby enhancing the strength of the heat exchanger 10.

In the first preferred embodiment, the protrusions 77 are in the form of spaced dimples having a truncated cone shape, the upper surfaces 79 of the protrusions being flat. Preferably, both the top and bottom walls 14, 16 are provided with protrusions 77 arranged in the same pattern so that the upper surfaces 79 of the protrusions 77 of adjacent tubes 12 engage one another as shown in FIG. 3. It will be appreciated that the tubes 12 may be provided with protrusions 77 other than, or in addition to, dimples 77. For example, the tubes could be provided with spaced, angled ribs provided in their top and/or bottom walls 14, 16.

The heat exchanger 10 preferably also comprises turbulence-enhancing inserts provided in one or more of the first fluid flow passages 30, preferably in all the first fluid flow passages 30. As shown in FIG. 5, the turbulence-enhancing inserts comprise a plurality of corrugated fins 80, each of which comprises a plurality of longitudinally-extending fin walls 82 having a height substantially equal to the height of the first fluid flow passages 30 in the central portions 26 of tubes 12. The fin walls 82 are connected by top and bottom walls 83, 84 which are in heat exchange contact with the top and bottom walls 14, 16, respectively, of tubes 12. In order to maximize contact between the fins 80 and tubes 12, the top and bottom walls 83, 84 of fins 80 may preferably be flat, although this is not necessary.

Figure 6:
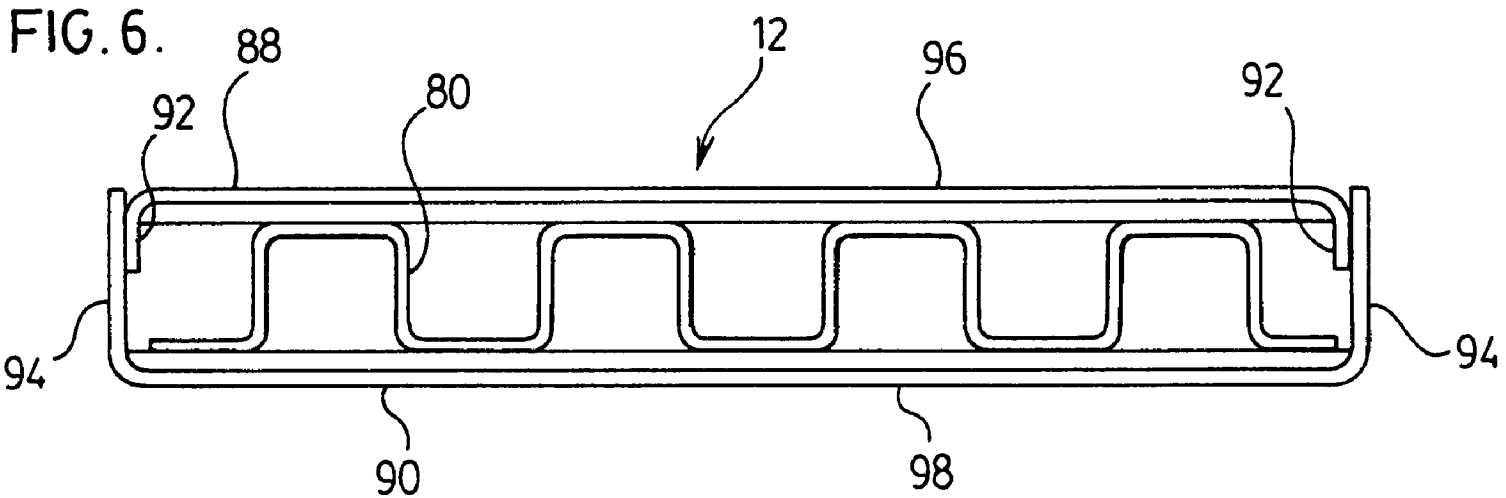
FIG. 6 is a front elevation view of one of the tubes making up the heat exchanger of FIG. 1.

In order to simplify the manufacturing process and reduce cost, it is preferred that each of the tubes 12 is comprised of a pair of plates, which in the first preferred embodiment, are identified as upper plate 88 and lower plate 90 (FIGS. 5 and 6). Each of the plates have a pair of longitudinally-extending side portions along which the plates 88, 90 are sealed together. In the first preferred embodiment, the plates 88, 90 are generally U-shaped, with the upper plate 88 having a pair of identical side portions 92 joined by a substantially flat middle portion 96, and the lower plate 90 has a pair of identical side portions 94 joined by a substantially flat middle portion 98. The angle between middle portions 96, 98 and respective side portions 92, 94 is about 90 degrees.

Figure 13:
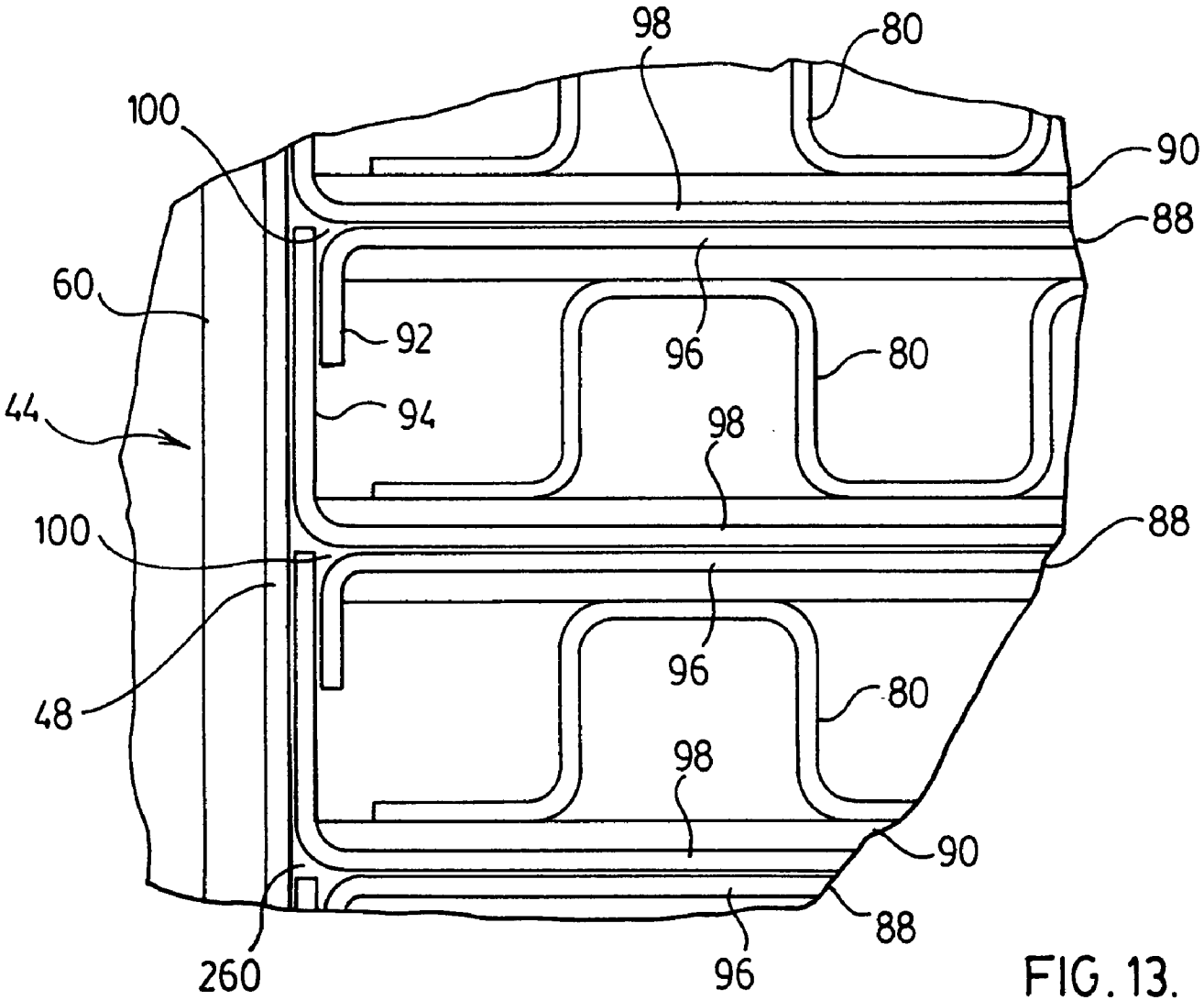
FIG. 13 is a close-up of area C of FIG. 5.

In order to provide good sealing contact between the plates 88, 90, the side portions 92, 94 of the plates 88, 90 are preferably in nested relation. This is shown in FIGS. 5 and 6, from which it can be seen that the shorter side portions 92 of the upper plate 88 are completely nested inside (i.e. between) the relatively longer side portions 94 of lower plate 90, thereby providing good contact for a braze joint between the side portions 92, 94. It can also be seen from the end view of FIG. 5 that the side portions 94 of lower plate 90 are sufficiently long to extend up to the top wall 14 of tube 12 in the end portions 22, 24 thereof, and preferably into contact with the bottom wall 16 of an upwardly adjacent tube 12. As shown in FIGS. 5 and 13, this minimizes the size of the gaps 100 formed between the side walls 18, 20 of adjacent tubes 12, thereby ensuring that a well sealed braze joint will be formed between the side walls of tubes 12 and the side plates 44.

In the tube 12 shown in FIG. 6, the corrugated fin 80 also serves as a spacer to maintain the desired degree of nesting between plates 88, 90 and the height of first fluid flow passages 30.

Figure 7:
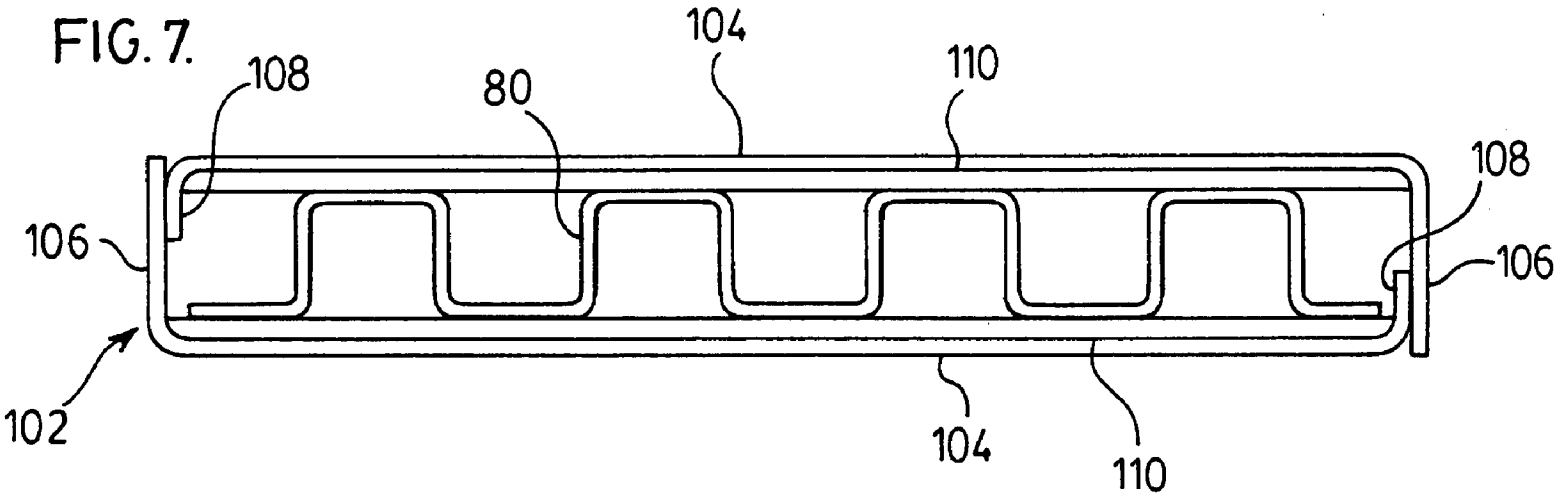
FIG. 7 is a front elevation view of an alternate tube construction for use in a heat exchanger according to the invention.

It will be appreciated that the construction of the tubes for heat exchangers according to the invention may vary from that shown in FIGS. 1 to 6. FIG. 7 shows an alternate construction for a heat exchanger tube 102 which, except for the details of its construction described below, is preferably identical to tube 12. The tube 102 comprises a pair of identical U-shaped plates 104 having a pair of side portions 106, 108 joined by a middle portion 110. The side portions 106, 108 are of different lengths, with side portion 106 being higher than side portion 108. When two plates 104 are brought together in nested engagement as shown in FIG. 6, the higher side portions 106 are on the outside of the shorter side portions 108. As in tube 12, a corrugated fin 80 is preferably provided for turbulence and to maintain the spacing between the plates 104.

Figure 8:
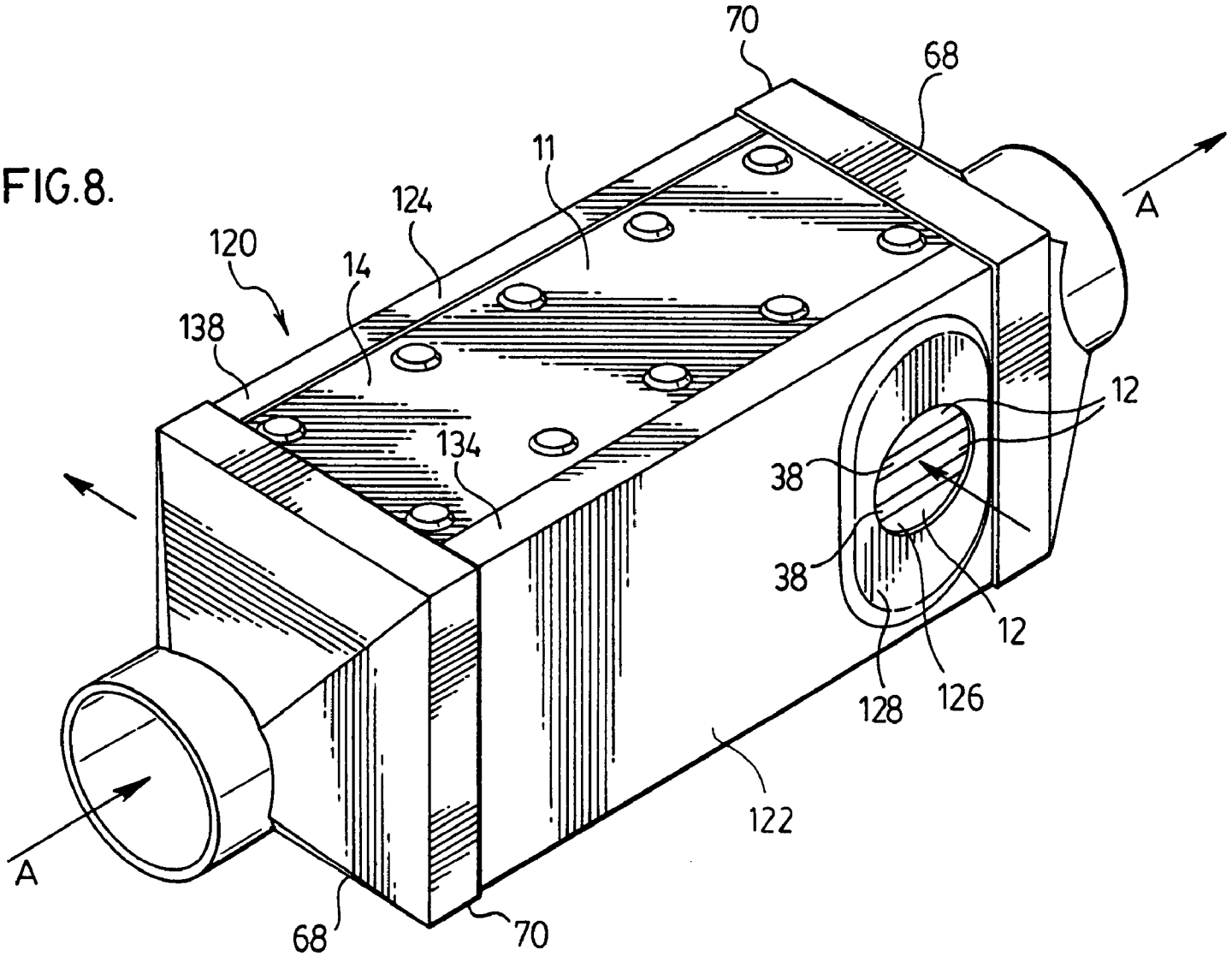
FIG. 8 is a perspective view of a heat exchanger according to a second preferred embodiment of the invention.
Figure 9:
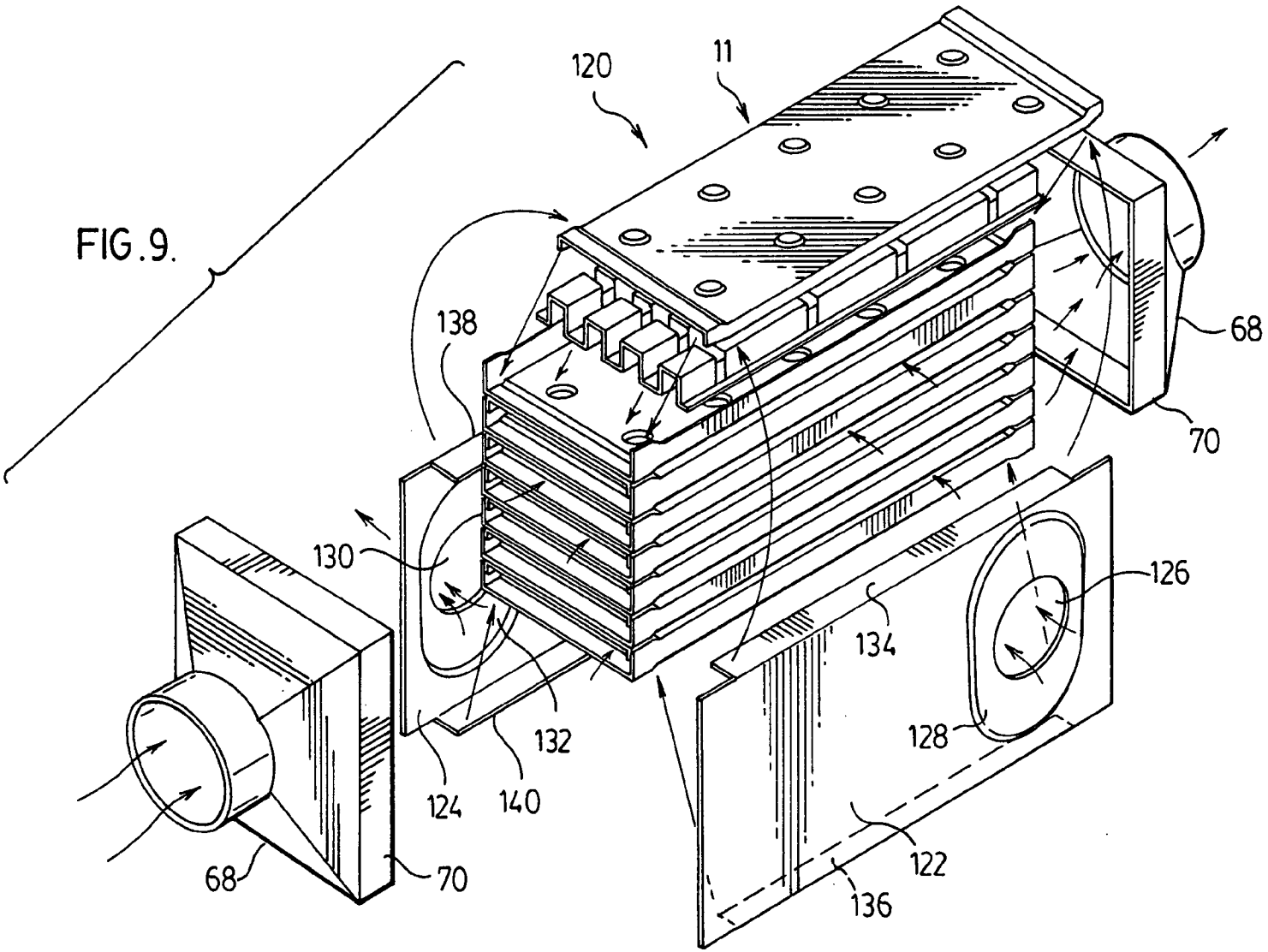
FIG. 9 is an exploded perspective view of the heat exchanger of FIG. 8.

A second preferred heat exchanger 120 according to the invention is now described with reference to FIGS. 8 and 9. Heat exchanger 120 includes a core 11 and end fittings 68 which are identical to those of heat exchanger 10 described above. Heat exchanger 120 differs from heat exchanger 10 in that it does not include a housing 44, but rather utilizes a pair of side plates 122, 124 to seal the sides of the second fluid flow passages 38. Side plate 122 is provided with an inlet opening 126 and an inlet manifold 128 and side plate 124 is provided with an outlet opening 130 and an outlet manifold 132, which are preferably identical to the inlet and outlet openings and manifolds of heat exchanger 10 described above. It will be appreciated that both the inlet and outlet openings 126, 130 and the associated manifolds 128, 132 may instead be provided side-by-side in one of the plates 122 or 124. Where the inlet and outlet openings 126, 130 are provided in opposite side plates 122, 124, they are not necessarily offset from one another, but rather may be directly opposite one another as described below in more detail.

Each side plate 122, 124 is sealed to the side walls 18, 20 of the tubes 12 along one side of the core 11, at least in the end portions 22, 24 of the tubes 12. The side plates 122, 124 are preferably U-shaped, having angled flanges which are sealed to the central portions 26 of the uppermost and lowermost tubes 12 in the core 11, thereby sealing the sides of the second fluid flow passages 38. The flanges preferably terminate short of the end portions 22, 24 of tubes 12. As shown in FIGS. 8 and 9, side plate 122 is provided with flanges 134, 136 and side plate 124 is provided with flanges 138, 140. One flange 134 of plate 122 is sealed to the top wall 14 of the uppermost tube 12 and, although not visible in the drawings, the other flange 136 is sealed to the bottom wall 16 of the lowermost tube 12. Similarly, the flanges 138, 140 of the other plate 124 are sealed to the uppermost and lowermost tubes 12, respectively.

Preferably, during assembly of the heat exchanger 10, the angled flanges of plates 122, 124 frictionally engage the uppermost and lowermost tubes 12, thereby reducing or eliminating the need for additional fixturing means to keep the tubes 12 from shifting their relative positions in the core 11 prior to brazing. Accordingly, the side plates 122, 124 provide "self-fixturing" during assembly of the heat exchanger and simplify the manufacturing process.

Figure 10:
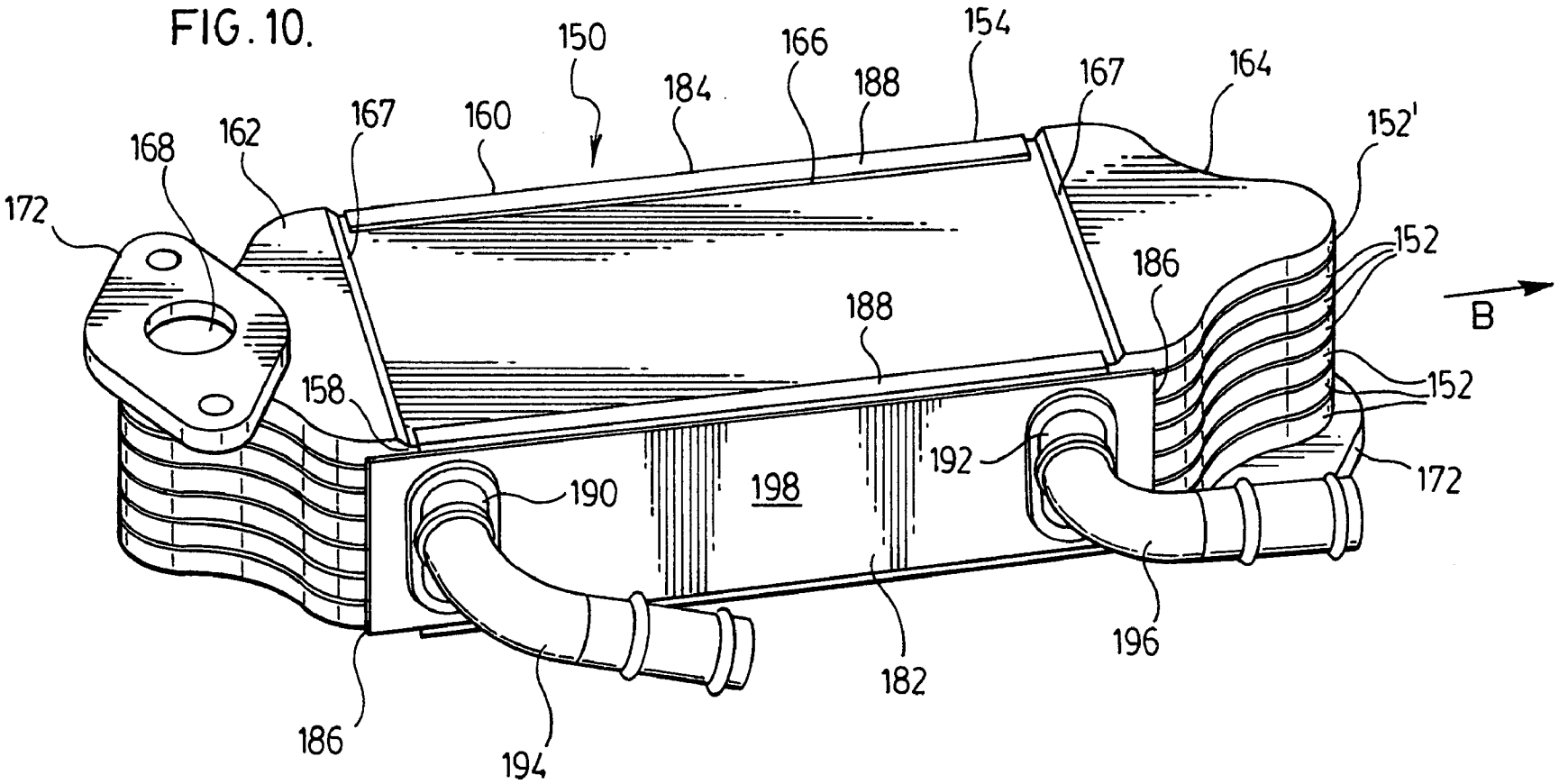
FIG. 10 is a perspective view of a heat exchanger according to a third preferred embodiment of the invention.
Figure 11:
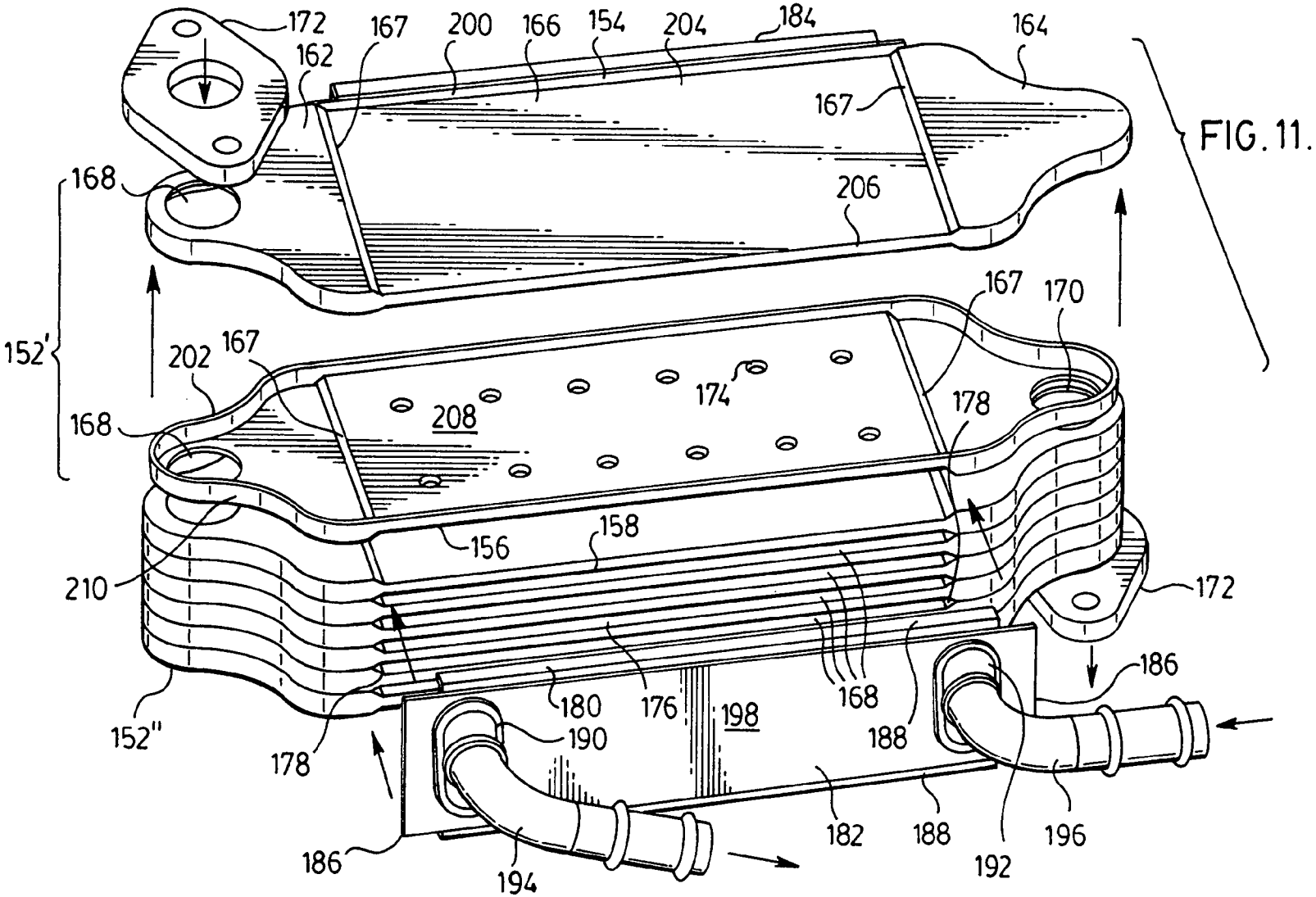
FIG. 11 is an exploded perspective view of the heat exchanger of FIG. 10.

FIGS. 10 and 11 illustrate a third preferred heat exchanger 150 according to the invention. Heat exchanger 150 includes a core comprising a stack of tubes 152 which are similar to tubes 12 in that each has a top wall 154, an opposed bottom wall 156 and a pair of side walls 158, 160. The tubes 152 each have a pair of longitudinally spaced end portions 162, 164 and a central portion 166 located between the end portions 162, 164. The end portions 162, 164 of the tubes have a vertical height greater than a height of the central portion, with a raised shoulder 167 being provided between the central portion 166 and the end portions 162, 164. Accordingly, the central portions 166 of adjacent tubes 152 are spaced apart and the end portions 162, 164 of adjacent tubes 152 are sealed to one another along their top and bottom walls 154, 156.

The most significant difference between tubes 152 and tubes 12 is that the tubes 152 are not open-ended. Rather, the side walls 158, 160 of tube 152 form part of a continuous perimeter wall which seals the periphery of tube 152. Further, in all but the uppermost and lowermost tubes 152, the end portion 162 is provided with aligned openings 168 extending through both the top and bottom walls 154, 156 and the opposite end portion 164 is provided with aligned openings 170 extending through both the top and bottom walls 154, 156. In FIG. 11, the uppermost tube is labeled 152' and the lowermost tube is labeled 152". In the uppermost tube 152', the end portion 162 is provided with a connection flange 172 which communicates with the aligned openings 168 and the opposite end portion 164 is provided with an opening 170 only in its bottom wall 156. There is no opening 170 in the top wall 154; it is either missing entirely or plugged. Similarly, the end portion 164 of lowermost tube 152" is provided with a connection flange 172 and, although not seen in the drawings, the opposite end portion 162 is provided with an opening only in its upper wall 154. There is no opening 168 in the bottom wall 156; it is either missing entirely or plugged. Therefore, the first fluid, which may preferably comprise a hot exhaust gas, enters the heat exchanger 150 through one of the connection flanges 172, flows through the interiors of the tubes 152 and exits the heat exchanger 150 through the other connection flange 172. The aligned openings 168 and 170 of tubes 152 provide integrally formed inlet and outlet manifolds and eliminate the need for end fittings as in the first and second embodiments.

Like tubes 12 described above, tubes 152 preferably also have a rectangular cross section and the top and bottom walls 154, 156 are preferably also provided with protrusions 174 which may be in the form of truncated conical dimples. It will be appreciated that the tubes 152 may be provided with protrusions other than, or in addition to, dimples 174. For example, the tubes 152 could be provided with spaced, angled ribs provided in their top and/or bottom walls 154, 156. As shown in FIG. 11, the top wall 154 of uppermost plate 152' may preferably be free of protrusions 174 since they would serve no purpose in heat exchanger 150. The bottom wall 156 of lowermost plate 152" may similarly be free of protrusions 174.

Although not shown in FIGS. 10 and 11, the interiors of the first fluid flow passages may preferably be provided with corrugated fins which may be identical to fins 80 described above.

A plurality of second fluid flow passages 176 are defined by the spaces between the central portions 166 of adjacent tubes 152. Each second fluid flow passage 176 has a pair of longitudinally spaced ends 178 and a pair of transversely spaced sides 180. As shown in FIG. 11, the second fluid flow passages 176 are sealed at their ends 178 by the sealed end portions 162, 164 of the adjacent tubes 152 between which they are formed.

Heat exchanger 150 further comprises a pair of side plates 182, 184 which seal the sides 180 of the second fluid flow passages 176. Each of the side plates 182, 184 has a pair of longitudinally-spaced ends 186 and a pair of flanges 188. In the preferred heat exchanger 150, the side plate 182 is provided with both the second fluid inlet and outlet openings 190, 192 while the side plate 184 (of which only one flange is visible in FIG. 10) does not have an inlet or outlet for the second fluid. It will be appreciated that the second fluid inlet and outlet openings 190, 192 could instead be provided in opposite side plates 182, 184 and may either be offset or directly opposite one another. The second fluid inlet and outlet openings 190, 192 are also shown in FIGS. 10 and 11 as being provided with inlet and outlet fittings 194, 196 respectively.

Each side plate 182, 184 is sealed to the side walls 158, 160 of the tubes 152 along one side of the core 11, at least near its ends. Furthermore, the flanges 188 of each side plate 182, 184 are sealed to an uppermost tube 152 in the stack and to the lowermost tube 152 in the stack. Therefore, the side plates 182, 184 seal the sides 180 of the second fluid flow passages 176 as in heat exchanger 120 described above.

The side plates 182, 184 are preferably U-shaped, with the flanges 188 being angled relative to the plate side wall 198. The angle between the edges 188 and the plate side wall is preferably about 90 degrees. As with plates 44 described above, the flanges 188 of plates 182, 184 preferably frictionally engage the uppermost and lowermost tubes 152', 152" during assembly, thereby reducing or preferably eliminating the need for additional fixturing means to keep the tubes 152 from shifting their relative positions in the core prior to brazing. Rather than using side plates 182, 184, it will be appreciated that the heat exchanger 150 could instead be provided with a housing similar or identical to housing 44 described above.

As shown in FIG. 11, each of the tubes 152 is preferably comprised of a pair of plates, an upper plate 200 and a lower plate 202. Upper plate 200 comprises a substantially flat middle portion 204 a continuous peripheral flange 206 and lower plate 202 similarly comprises a middle portion 208 and a continuous peripheral flange 210. One of the flanges 206, 210 nests within the other flange as described above with reference to heat exchanger 10.

Figure 12:
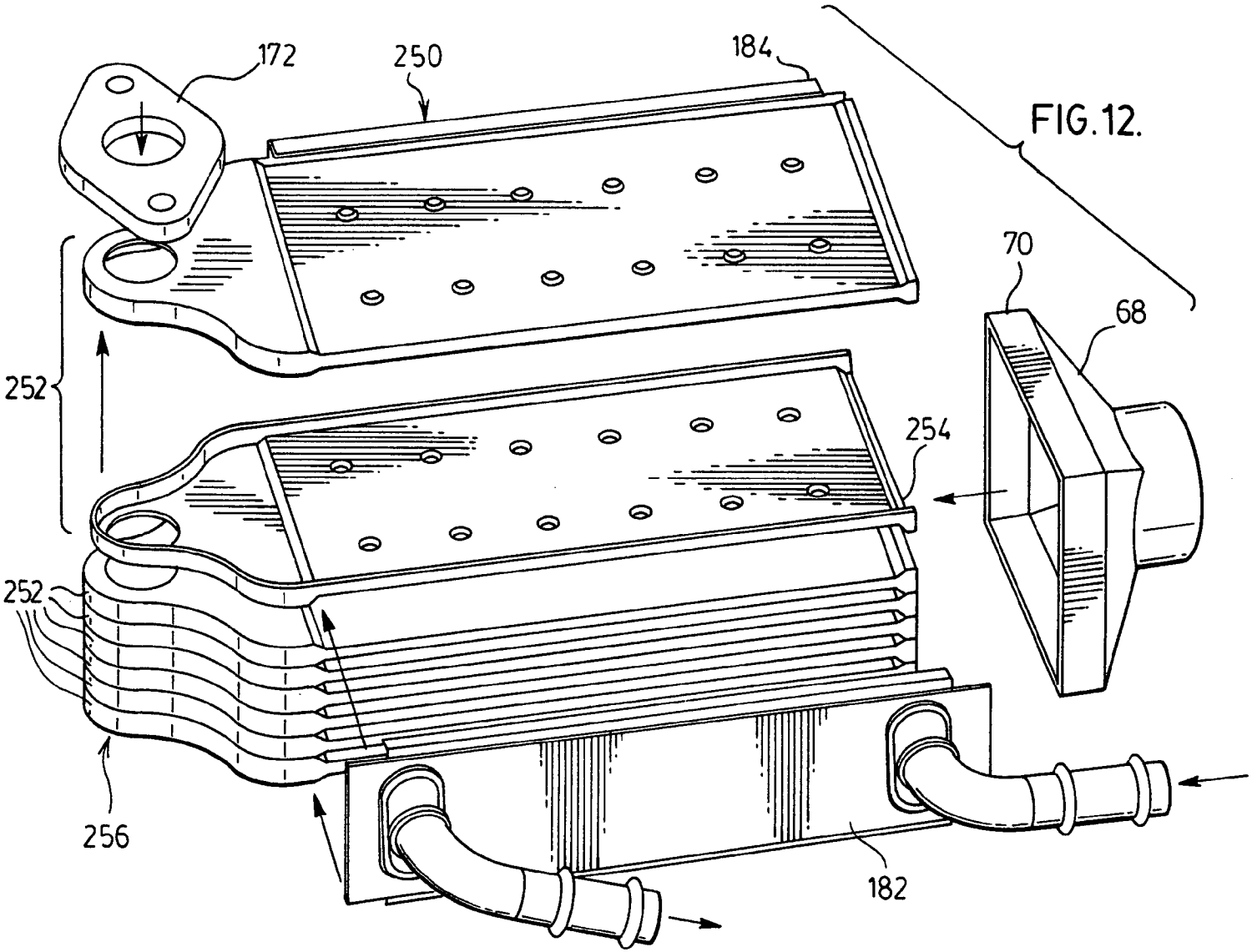
FIG. 12 is an exploded perspective view of a heat exchanger according to a fourth preferred embodiment of the invention.

FIG. 12 illustrates a heat exchanger 250 according to a fourth preferred embodiment of the invention. Heat exchanger 250 is a hybrid of the second and third embodiments in that the tubes 252 of heat exchanger 250 have first end portions. 254 which are open-ended as in heat exchanger 10 and second end portions 256 which form an integral manifold as in heat exchanger 150. The other components of heat exchanger 250, namely connecting flange 172, side plates 182, 184 and end fitting 68, are as described above.

Figure 14:
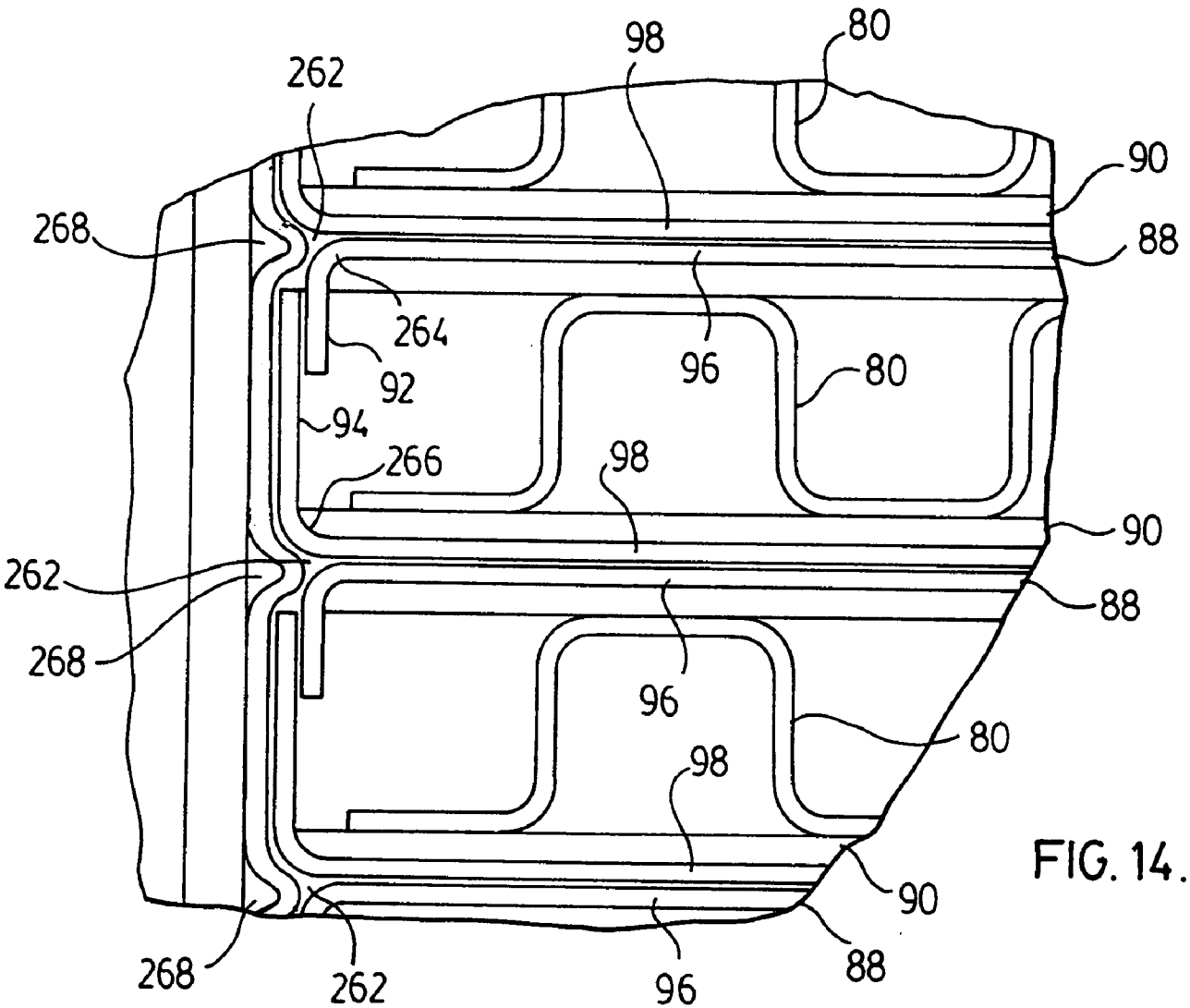
FIG. 14 is a close-up of a portion of a heat exchanger according to a fifth preferred embodiment of the invention.

A further preferred feature of the invention is now described below with reference to FIGS. 13 and 14. FIG. 13 is a close-up of area C of FIG. 5. In order to provide a seal between the tubes 12 and the side plates 46, 48 of housing 44, it is necessary to completely fill all the gaps between the tubes 12 and the side plates 46, 48 with filler metal. As shown in FIG. 13, there is an approximately triangular-shaped gap 100 at the point where two tubes 12 abut the side plates 46, 48 (only side plate 48 is shown in FIG. 13). If this gap 100 is too large, filler metal will not reliably be drawn into the gap by capillary flow. In order to provide more reliable sealing, it may be preferred to modify the tubes 12 and the side plates 46, 48 as shown in FIG. 14 so as to provide a narrower gap 262 which will be more readily filled. Firstly, according to the modified structure of FIG. 14, the shapes of the plates 88, 90 making up tubes 12 are somewhat modified to have slightly more rounded edges 264, 266 and the height of the side portions 94 of lower plates 90 are somewhat reduced. Secondly, the side plates 46, 48 (only plate 48 is visible in the close-up of FIG. 14) are formed with ribs 268, at least near the ends of the side plates 46, 48. These ribs 268 extend into the area between adjacent tubes 12 so as to provide a relatively narrow gap 262.

Figure 15:
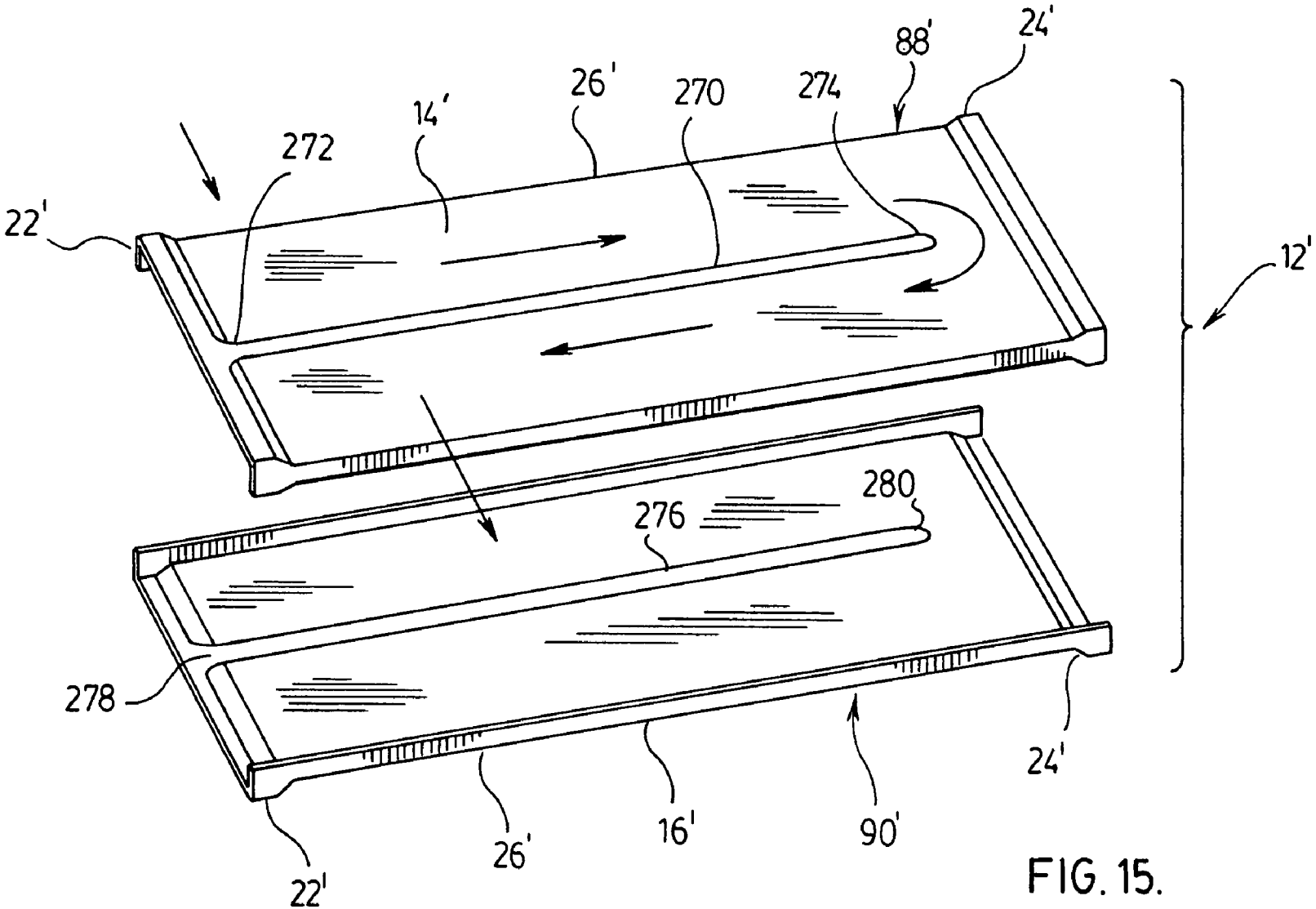
FIG. 15 is a perspective view of one plate pair of a heat exchanger according to a sixth preferred embodiment of the invention.

FIG. 15 illustrates a pair of plates 88' and 90' of a heat exchanger according to a sixth preferred embodiment of the invention. Plates 88' and 90' together define a heat exchanger tube 12' which is substantially identical to tubes 12 of heat exchanger 10 described above except that the upper surface 14' of tube 12' is provided with an elongate, upstanding rib 270 extending longitudinally from one end portion 22' and along the central portion 26' of tube 12'. The rib 270 has a height which is substantially the same as that of the end portion 22' and has one end 272 which preferably forms a smooth transition with the end portion 22' of tube 12'. The other end 274 of rib 270 is spaced from the other end portion 24' of tube 12'. Similarly, the lower surface 16' of tube 12' is provided with an elongate, depressed rib 276 extending longitudinally from end portion 22'. The rib 276 has a height which is substantially the same as that of end portion 22', has one end 278 which preferably forms a smooth transition with the end portion 22' of tube 12' and an opposite end 280 spaced from the other end portion 22'. The same effect will be produced by providing only one of the upper surface 14' or the lower surface 16' of tube 12' with a rib which has a height equal to the height of the second fluid flow passage 38 between adjacent tubes 12'.

When a core 11' (not shown) is formed by stacking tubes 12', the ribs 270, 276 of adjacent tubes 12' engage one another, thereby forming a barrier against transverse flow of the second fluid directly across the core. Rather, the second fluid must flow around the flow barrier formed by ribs 270, 276 and pass through a gap between the ends 274, 280 of ribs 270, 276 and the end portions 24' of the adjacent tubes 12'. In this embodiment, it may be advantageous to locate the second fluid inlet and outlet openings (not shown) of the side plates (not shown) directly across the core 11' from one another, and adjacent the ends 22' of tubes 12', so as to maximize the length of the flow path followed by the second heat exchange fluid. The flow between an inlet and outlet situated in these positions is indicated by the arrows in FIG. 15. It will be appreciated that ribs may instead be provided in the tube interiors to lengthen the flow path of the first fluid in a similar manner.

A heat exchanger 300 according to a seventh preferred embodiment of the invention is now described below with reference to FIGS. 16 and 17. Heat exchanger 300 includes a core 11 and a pair of end fittings 68 which are shown as being identical to those of heat exchangers 10 and 120 described above. Heat exchanger 300 further comprises a pair of side plates 122', 124' which are similar to side plates 122, 124 of heat exchanger 120 and are therefore described using like reference numerals.

The side plates 122', 124' seal the sides of the second fluid flow passages 38. Side plate 122' is provided with an inlet opening 126' and a raised inlet manifold 128' and side plate 124' is provided with an outlet opening 130' and a raised outlet manifold 132'.

Figure 16:
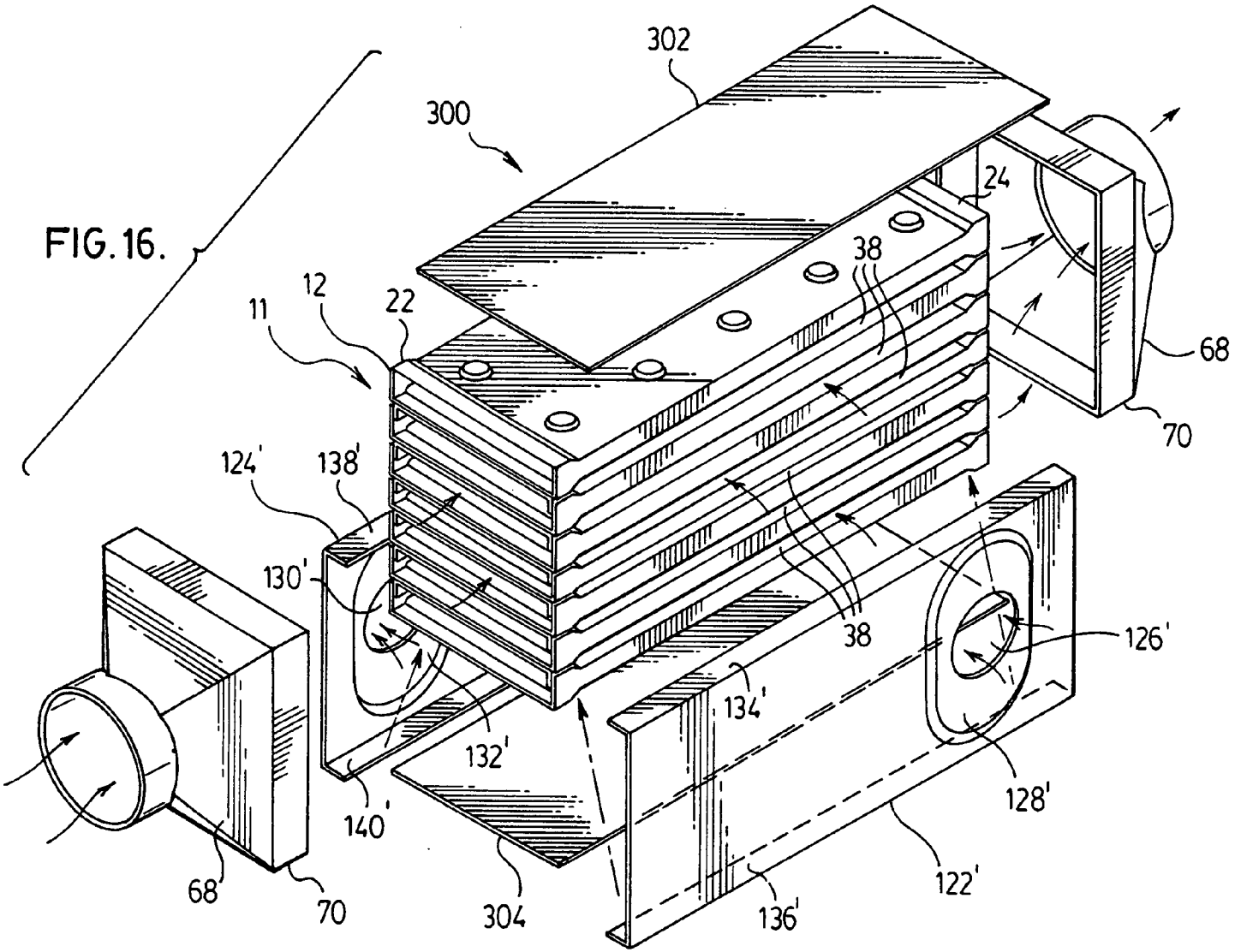
FIG. 16 is an exploded perspective view of a heat exchanger according to a seventh preferred embodiment of the invention.
Figure 17:
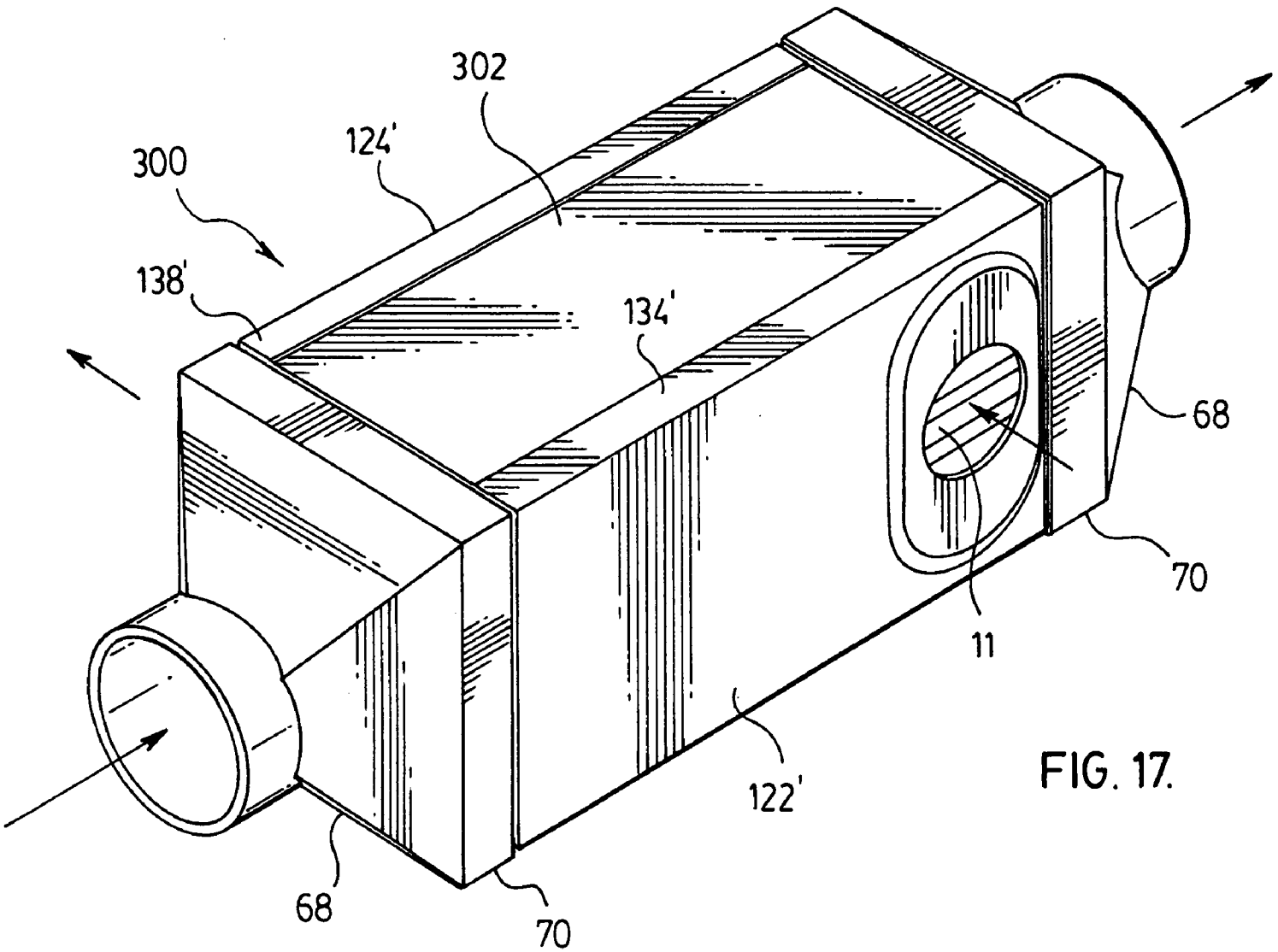
FIG. 17 is a perspective view of the heat exchanger of FIG. 16.

Heat exchanger 300 further comprises a pair of end plates 302, 304 which, in the preferred embodiment of FIGS. 16 and 17, are flat and rectangular. The end plates are of a length sufficient to overlap with and sealingly engage the end portions 22, 24 of the uppermost and lowermost tubes 12 of the core 11. The end plates 302, 304 preferably are of substantially the same width as the core 11. Therefore, additional second fluid flow passages are formed between the end plates 302, 304 and the core 11, in an identical manner as described above with reference to the end plates 50, 52 of heat exchanger 10.

Each side plate 122', 124' overlaps and is sealed to sides of the core 11 in the manner described above with reference to heat exchanger 150. The side plates 122', 124' are preferably U-shaped, having angled flanges which are sealed to the end plates 302, 304, thereby sealing the sides of the second fluid flow passages 38. The flanges preferably extend the full length of the end plates 302, 304. As shown in FIGS. 16 and 17, side plate 122' is provided with flanges 134', 136' and side plate 124' is provided with flanges 138', 140'. One flange 134' of plate 122' is sealed to the upper end plate 302 the other flange 136' is sealed to the lower end plate 304. Similarly, the flanges 138', 140' of the other plate 124' are sealed to the upper and lower end plates 302, 304, respectively.

Preferably, during assembly of the heat exchanger 300, the angled flanges 134', 136', 138', 140' of plates 122', 124' frictionally engage the end plates 302, 304, thereby reducing or eliminating the need for additional fixturing means to keep the end plates 302, 304 and the tubes 12 of core 11 from shifting their relative positions prior to being joined, for example by brazing. Accordingly, the side plates 122', 124' provide "self-fixturing" during assembly of the heat exchanger and simplify the manufacturing process.

The heat exchanger 300 is shown in its assembled state in FIG. 17. As shown, the flanges 70 of end fittings 68 may preferably be spaced from the side plates 122', 124' and the end plates 302, 304 in the manner described above with reference to FIG. 4A. Alternatively, the end plates 302, 304 may be overlapped by the fittings 68 in the manner shown in FIG. 4B, in which case it may be preferred to use side plates 122, 124 identical to those of heat exchanger 150 in which the flanges 134, 136, 138, 140 which terminate short of the ends of the plates 122, 124 such that the flanges are not overlapped by the fittings 68. Alternatively, the end plates 302, 304 may overlap the fittings 68 in the manner shown in FIG. 4C.

Although the invention has been described in connection with certain preferred embodiments, it is not limited thereto. Rather, the invention includes within its scope all embodiments which may fall within the scope of the following claims.

The invention claimed is:

1. A heat exchanger for heat transfer between a first fluid and a second fluid, the heat exchanger comprising:

(a) a core comprising a stack of tubes, each of the tubes having a top wall, a bottom wall, side walls connecting the top and bottom walls, a hollow interior enclosed by the top, bottom and side walls, and inlet and outlet openings for the first fluid;

wherein each of the tubes has a pair of end portions spaced apart along a longitudinal axis and a central portion located between the end portions, the end portions of adjacent tubes in the core being sealed to one another along their top and bottom walls, wherein the end portions are greater in height than the central portions of the tubes such that the central portions of adjacent tubes in the core are spaced from one another;

(b) a plurality of first fluid flow passages, each of which comprises the hollow interior of one of the tubes and extends longitudinally from the first fluid inlet opening to the first fluid outlet opening;

(c) a plurality of second fluid flow passages, each of which comprises the space between the central portions of an adjacent pair of said tubes, each of the second fluid flow passages having a pair of longitudinally-spaced ends and a pair of transversely spaced sides, each of the second fluid flow passages being sealed along its ends by the end portions of said adjacent pair of tubes; and (d) a pair of side plates covering the transversely spaced sides of the second fluid flow passages, each of the side plates having a substantially flat side wall which engages the side walls of the tubes in the core and is sealed to the tube side walls in the end portions of the tubes, wherein a second fluid inlet manifold is provided in one of the side plates and a second fluid outlet manifold is provided in one of the side plates, each of the manifolds communicating with each of the second fluid flow passages;

wherein portions of each of the side walls of the tubes which are in engagement with or sealed to one of the side plates are substantially flat and coplanar with one another.

2. The heat exchanger according to claim 1, further comprising a top plate extending between the side plates and sealed to the top wall of an uppermost tube in the core, in the end portions thereof, the top plate being spaced from the central portion of the uppermost tube so as to form an uppermost flow passage for the second fluid, the uppermost flow passage being in communication with the second fluid inlet and outlet manifolds.

3. The heat exchanger according to claim 2, further comprising a bottom plate extending between the side plates and sealed to the end portions in the bottom wall of a lowermost tube in the core, the bottom plate being spaced from the central portion in the bottom wall of the lowermost tube so as to form a lowermost flow passage for the second fluid, the lowermost flow passage being in communication with the inlet and outlet manifolds.

4. The heat exchanger according to claim 3, wherein the side plates, top plate and bottom plate comprise a continuous housing covering the core along its top, bottom and side surfaces.

5. The heat exchanger according to claim 4, wherein the housing is formed from either a cylindrical tube or from a sheet of metal.

6. The heat exchanger according to claim 1, wherein each of the manifolds comprises an upstanding portion of the side plate in which the side wall of the plate is spaced from the side walls of the tubes.

7. The heat exchanger according to claim 1, wherein both the inlet and outlet manifolds are formed in one of the side plates.

8. The heat exchanger according to claim 1, wherein the inlet manifold is formed in a first one of the side plates and the outlet manifold is formed in a second one of the side plates.

9. The heat exchanger according to claim 1, wherein the end portions of the tubes comprise upstanding shoulders on both the top and bottom walls and substantially flat end surfaces extending between the shoulders and the ends of the tubes, and wherein adjacent tubes in said core engage one another and are sealed together along their substantially flat end surfaces.

10. The heat exchanger according to claim 1, wherein each of the tubes has a rectangular transverse cross-sectional shape, wherein the top and bottom walls are substantially flat and parallel to one another, and wherein the side walls of the tubes are substantially flat and parallel to one another.

11. The heat exchanger according to claim 1, wherein the tubes are of constant width.

12. The heat exchanger according to claim 1, wherein the tubes are open-ended and the first fluid inlet and outlet openings are formed at the open ends of the tubes, and wherein the heat exchanger further comprises inlet and outlet fittings located at opposite ends of the core and communicating with the open ends of the tubes.

13. The heat exchanger according to claim 12, wherein each of the inlet and outlet fittings comprises a longitudinal flange which overlaps with and is sealed to the end portions of the tubes.

14. The heat exchanger according to claim 13, wherein a longitudinally-extending gap is provided between the longitudinal flange of each of the end fittings and the side plates.

15. The heat exchanger according to claim 14, further comprising:

(a) a top plate extending between the side plates and sealed to the top wall of an uppermost tube in the core, in the end portions thereof, the top plate being spaced from the central portion of the uppermost tube so as to form an uppermost flow passage for the second fluid, the uppermost flow passage being in communication with the second fluid inlet and outlet manifolds; and (b) a bottom plate extending between the side plates and sealed to the end portions in the bottom wall of a lowermost tube in the core, the bottom plate being spaced from the central portion in the bottom wall of the lowermost tube so as to form a lowermost flow passage for the second fluid, the lowermost flow passage being in communication with the inlet and outlet manifolds;

wherein the longitudinal flange of each of the end fittings is spaced longitudinally from the top and bottom plates.

16. The heat exchanger according to claim 1, wherein at least one of the first fluid inlet opening and the first fluid outlet opening of each tube comprises a pair of aligned apertures in one of the end portions of said tube, one of the apertures being formed in the top wall of the tube and the other aperture being formed in the bottom wall of the tube, and wherein the apertures in adjacent tubes align with one another to form an inlet and/or outlet manifold of the heat exchanger.

17. The heat exchanger according to claim 1, wherein the central portions of the tubes are provided with upstanding protrusions in one or both of their top and bottom walls, the protrusions each having an upper surface which engages the top or bottom wall of the same tube or an adjacent tube.

18. The heat exchanger according to claim 17, wherein the protrusions of adjacent tubes engage each other.

19. The heat exchanger according to claim 1, wherein turbulence-enhancing inserts are provided in one or more of the first fluid flow passages, each of the turbulence-enhancing inserts having a height which is substantially the same as a height of the first fluid flow passage in which it is received, and wherein each of the turbulence-enhancing inserts has an upper surface engaging the top wall of the tube and a lower surface engaging the bottom wall of the tube.

20. The heat exchanger according to claim 1, wherein each of the side plates is U-shaped, comprising a side wall covering one side of the core and a pair of longitudinally-extending flanges angled relative to the side wall, one of the flanges sealingly engaging the top wall of the uppermost tube in the core and the other of the flanges sealingly engaging the bottom wall of the lowermost tube in the core.

21. A heat exchanger for heat transfer between a first fluid and a second fluid, the heat exchanger comprising:

(a) a core comprising a stack of tubes, each of the tubes having a top wall, a bottom wall, side walls connecting the top and bottom walls, a hollow interior enclosed by the top, bottom and side walls, and inlet and outlet openings for the first fluid;

wherein each of the tubes has a pair of end portions spaced apart along a longitudinal axis and a central portion located between the end portions, the end portions of adjacent tubes in the core being sealed to one another along their top and bottom walls, wherein the end portions are greater in height than the central portions of the tubes such that the central portions of adjacent tubes in the core are spaced from one another;

(b) a plurality of first fluid flow passages, each of which comprises the hollow interior of one of the tubes and extends longitudinally from the first fluid inlet opening to the first fluid outlet opening;

(c) a plurality of second fluid flow passages, each of which comprises the space between the central portions of an adjacent pair of said tubes, each of the second fluid flow passages having a pair of longitudinally-spaced ends and a pair of transversely spaced sides, each of the second fluid flow passages being sealed along its ends by the end portions of said adjacent pair of tubes; and (d) a pair of side plates covering the transversely spaced sides of the second fluid flow passages, the side plates engaging the side walls of the tubes in the core and being sealed to the tube side walls in the end portions of the tubes, wherein a second fluid inlet manifold is provided in one of the side plates and a second fluid outlet manifold is provided in one of the side plates, each of the manifolds communicating with each of the second fluid flow passages;

wherein gaps are formed between the side walls of adjacent tubes in the core, in the end portions thereof, and wherein the side plates have end portions which are provided with a series of spaced ribs which extend into and at least partially fill said gaps.

22. A method for manufacturing a heat exchanger comprising a core comprised of a stack of open-ended tubes, each of the tubes having a top wall, a bottom wall, side walls connecting the top and bottom walls, a hollow interior enclosed by the top, bottom and side walls, and inlet and outlet openings for the first fluid, wherein each of the tubes has a pair of end portions spaced apart along a longitudinal axis and a central portion located between the end portions, the end portions of adjacent tubes in the core being sealed to one another along their top and bottom walls, wherein the end portions are greater in height than the central portions of the tubes such that the central portions of adjacent tubes in the core are spaced from one another; a plurality of first fluid flow passages, each of which comprises the hollow interior of one of the tubes and extends longitudinally from one open end of the tube to the other open end; a plurality of second fluid flow passages, each of which comprises the space between the central portions of an adjacent pair of said tubes, each of the second fluid flow passages having a pair of longitudinally-spaced ends and a pair of transversely spaced sides, each of the second fluid flow passages being sealed along its ends by the end portions of said adjacent pair of tubes; and a pair of U-shaped side plates, each of which has a side wall covering one side of the core and a pair of longitudinally-extending edges which are sealed to an uppermost tube in the core and a lowermost tube in the core, respectively, the side plates having inlet and outlet openings for the second fluid; the method comprising:

(a) stacking said tubes to form said core;

(b) attaching said U-shaped side plates to opposite sides of the core with one of the longitudinally-extending edges of each side plate engaging the top wall of the uppermost tube in the core and the other edge of each side plate engaging the bottom wall of the lowermost tube in the core, wherein the edges of the side plates frictionally engage the uppermost and lowermost tubes to retain the tubes in position in said core; and (c) heating the core with the attached side plates for a time and at a temperature sufficient to seal the end portions of adjacent tubes together, to seal the longitudinally-extending edges of the side plates to the uppermost and lowermost tubes in the core, and to seal the side plates to the tube side walls in the end portions of the tubes.

23. The method of claim 22, further comprising the step of attaching inlet and outlet fittings to opposite ends of the core, the fittings having longitudinally-extending flanges which fit over, and frictionally engage, the end portions of the uppermost and lowermost tubes along their respective top and bottom walls, followed by joining the end fittings to the core.

24. A heat exchanger for heat transfer between a first fluid and a second fluid, the heat exchanger comprising:

(a) a core comprising a stack of tubes, each of the tubes having a top wall, a bottom wall, side walls connecting the top and bottom walls, a hollow interior enclosed by the top, bottom and side walls, and inlet and outlet openings for the first fluid;

wherein each of the tubes has a pair of end portions spaced apart along a longitudinal axis and a central portion located between the end portions, the end portions of adjacent tubes in the core being sealed to one another along their top and bottom walls, wherein the end portions are greater in height than the central portions of the tubes such that the central portions of adjacent tubes in the core are spaced from one another;

(b) a plurality of first fluid flow passages, each of which comprises the hollow interior of one of the tubes and extends longitudinally from the first fluid inlet opening to the first fluid outlet opening;

(c) a plurality of second fluid flow passages, each of which comprises the space between the central portions of an adjacent pair of said tubes, each of the second fluid flow passages having a pair of longitudinally-spaced ends and a pair of transversely spaced sides, each of the second fluid flow passages being sealed along its ends by the end portions of said adjacent pair of tubes; and (d) a pair of side plates covering the transversely spaced sides of the second fluid flow passages, the side plates engaging the side walls of the tubes in the core and being sealed to the tube side walls in the end portions of the tubes, wherein a second fluid inlet manifold is provided in one of the side plates and a second fluid outlet manifold is provided in one of the side plates, each of the manifolds communicating with each of the second fluid flow passages;

wherein each of the tubes comprises a first plate and a second plate, each of the plates being U-shaped and having a pair of longitudinally-extending side portions and a generally flat middle portion located between the side portions, wherein the side portions are angled relative to the middle portion, and wherein the plates are sealed together along their side portions with the middle portions spaced apart to define one of said first fluid flow passages;

wherein the side portions of each pair of plates are nested with one another such that each of the side walls of the tube is made up of one of the side portions of the first plate and one of the side portions of the second plate, the nested side portions being sealed together throughout their lengths; and wherein one of the side portions making up each of the side walls of the tube has a height which is substantially the same as a height of the tube throughout its entire length.

25. The heat exchanger according to claim 24, wherein the side portions of each of the plates are substantially parallel to one another and are angled by about 90 degrees relative to the middle portion.

26. The heat exchanger according to claim 24, wherein the side plates covering the sides of the second fluid flow passages engage the side portions having said height which is substantially the same as a height of the tube throughout its entire length.

27. The heat exchanger according to claim 24, wherein the other of the side portions making up each of the side walls of the tube has a height which is less than a height of the tube.

28. The heat exchanger according to claim 27, wherein both of the side portions of the first plate have said height which is substantially the same as a height of the tube throughout its entire length; and wherein both of the side portions of the second plate have said height which is less than a height of the tube.

29. The heat exchanger according to claim 27, wherein each of said plate pairs comprises a first plate and an identical second plate;

wherein said first plate has a first side portion having said height which is substantially the same as a height of the tube throughout its entire length and a second side portion having said height which is less than a height of the tube; and wherein said second plate has a first side portion having said height which is substantially the same as a height of the tube throughout its entire length and a second side portion having said height which is less than a height of the tube.

* * * * *